US006110004A

United States Patent [19]

McKinley et al.

[11] Patent Number: 6,110,004

[45] Date of Patent: Aug. 29, 2000

[54] ROOM-ENVIRONMENT STRING-PULL CONSTRUCTION TOY

[75] Inventors: William S. McKinley, Corte Madera; Adam Zev Tobin, San Anselmo, both of Calif.

[73] Assignee: Think Of It, Inc., Ventura, Calif.

[21] Appl. No.: 09/238,314

[22] Filed: Jan. 28, 1999

[51] Int. Cl.[7] ..... A63H 33/00

[52] U.S. Cl. ..... 446/490; 446/103; 434/302

[58] Field of Search ..... 446/96, 103, 119, 446/359, 490; 434/300, 302

[56] References Cited

U.S. PATENT DOCUMENTS

| | | | |
|---|---|---|---|
| 731,309 | 6/1903 | Kilbourn | 446/96 X |
| 2,828,634 | 4/1958 | Stevens | 446/490 X |
| 3,656,241 | 4/1972 | Chambers | 434/302 |
| 3,942,797 | 3/1976 | Shankel et al. | 446/490 X |
| 4,044,497 | 8/1977 | Bettens | 446/96 |
| 5,788,552 | 8/1998 | Alioto | 446/103 X |
| 5,803,784 | 9/1998 | Plow et al. | 446/490 X |
| 5,873,734 | 2/1999 | Griswold et al. | 434/302 X |

*Primary Examiner*—Sam Rimell
*Attorney, Agent, or Firm*—Laurence J. Shaw

[57] ABSTRACT

A room-environment string-pull construction toy consisting of a string, multiple wall-mountable pulleys, and a variety of colorful, eye-catching and/or whimsical cardboard or paper cutouts which can be mounted on the pulley wheels. Each wall-mountable pulley has a base with a non-permanent adhesive affixed to a back surface thereof, and an axle extending from a front surface thereof on which a pulley wheel is rotatably mounted. The configuration of the toy is constructed by attaching the pulleys to the walls and possibly the ceiling of a room, running the string over the pulleys, and attaching cutouts to the pulleys and string. Planar cutouts attached to the pulley wheels may be shaped as propellers, arrows, cams, disks and the like. Preferably, the cutouts are bright colors and/or are decorated with designs which have a striking appearance when in motion. Mechanical mechanisms assembled from cutouts may be affixed to the pulley wheels to provide visually interesting displays or perform useful mechanical functions such as the manipulation of room objects. The mechanical mechanisms may convert the circular motion of the pulley wheels to linear reciprocating motion, circular motion or chaotic motion. In one possible alternate embodiment the cutouts have fanciful shapes resembling the features of a human face, and are animated by mechanisms to perform fanciful and/or comical motions.

43 Claims, 16 Drawing Sheets

ROOM-ENVIRONMENT STRING-PULL CONSTRUCTION TOY

FIELD OF THE INVENTION

The present invention is directed to construction toys. The present invention is also directed to toys which include string as a component. The present invention is also directed to toys which engage with, interact with and/or attach to walls, ceilings, furniture or other objects in a room.

BACKGROUND OF THE INVENTION

While many different types of construction toys have been developed and marketed, in general these toys are composed entirely of rigid objects, such as wood, plastic or metal blocks and beams. Also, such construction toys are generally self-contained, i.e., they do not interface with objects or elements of a room.

Toys which incorporate a string are also generally self-contained. A classic example of such a toy is the yo-yo. In a similar vein is the Swinging Bob Toy of U.S. Pat. No. Re. 34,208 which has two balls secured at the ends of the string and a center ball which is free to slide along the string between the two end balls. Another classic string toy has a string attached to a rolling object so a child can pull the object behind him/her. In another type of classic string toy, the string is attached to a spring mounted in a housing, so that pulling the string away from the housing tightens the spring, and the unwinding of the spring powers some type of sound-generating or visually-interesting mechanism.

There are very few examples of toys which are designed to interact with objects or elements of a room, other than a flat horizontal surface, such as the table top or floor, upon which the toy is placed. Furthermore, those examples which do exist have very limited kinetic properties. Target toys, such as dart boards, are typically mounted on a wall, but once the target board is mounted it remains stationary and only the darts are kinetic. Another example of a type of toy which relies on the characteristics of a room is indoor planetariums which have perforated star maps which, when illuminated from below, cast images of constellations on the walls and ceiling. The perforated star maps may be rotated to simulate the movement of constellations in the night sky. A more fanciful variation of indoor planetariums is the packages of glow-in-the-dark plastic stars which can be mounted on the walls and ceiling of a child's room. Although the glow-in-the-dark stars may be attached to the walls and ceiling using a removable adhesive, generally the stars are left in place once they are mounted. It may be noted that none of these examples of toys which interact or attach to elements of a room incorporate any kinetic mechanical elements connecting to the walls or ceiling, nor do they incorporate room elements other than the walls and ceiling.

Therefore, it is an object of the present invention to provide a construction toy which includes string.

Furthermore, it is an object of the present invention to provide a construction toy where the motion of the elements of the toy is controlled by the string.

It is another object of the present invention to provide a construction toy which interfaces with room elements.

Furthermore, it is an object of the present invention to provide a construction toy which interfaces with room elements other than the floor, walls and ceiling.

Furthermore, it is an object of the present invention to provide a construction toy with kinetic mechanical elements.

Furthermore, it is another object of the present invention to provide a construction toy with kinetic mechanical elements which interfaces with room elements.

More particularly, it is an object of the present invention to provide a construction toy with kinetic mechanical elements driven by a string which interfaces with room elements, including room elements other than the floor, walls and ceiling.

Further objects and advantages of the present invention will become apparent from a consideration of the drawings and the ensuing detailed description. These various embodiments and their ramifications are addressed in greater detail in the Detailed Description.

SUMMARY OF THE INVENTION

A string-pull construction toy including a pulley having a base and a pulley wheel rotatably mounted on an axle extending from the base, a non-permanent adhesive to attach the base of the pulley to a room-environment surface, and a string which is to be passed over the circumferential groove of the pulley wheel of the pulley. The toy also includes an attachment at the distal end of the string which provides tension on the string when the string is pulled over the pulley wheel, thereby causing rotation of the pulley wheel.

BRIEF DESCRIPTION OF THE DRAWING

The accompanying drawings, which are incorporated in and form a part of the present specification, illustrate embodiments of the invention and together with the Detailed Description serve to explain the principles of the invention.

DETAILED DESCRIPTION OF THE PREFERRED EMBODIMENTS

Figure 1:
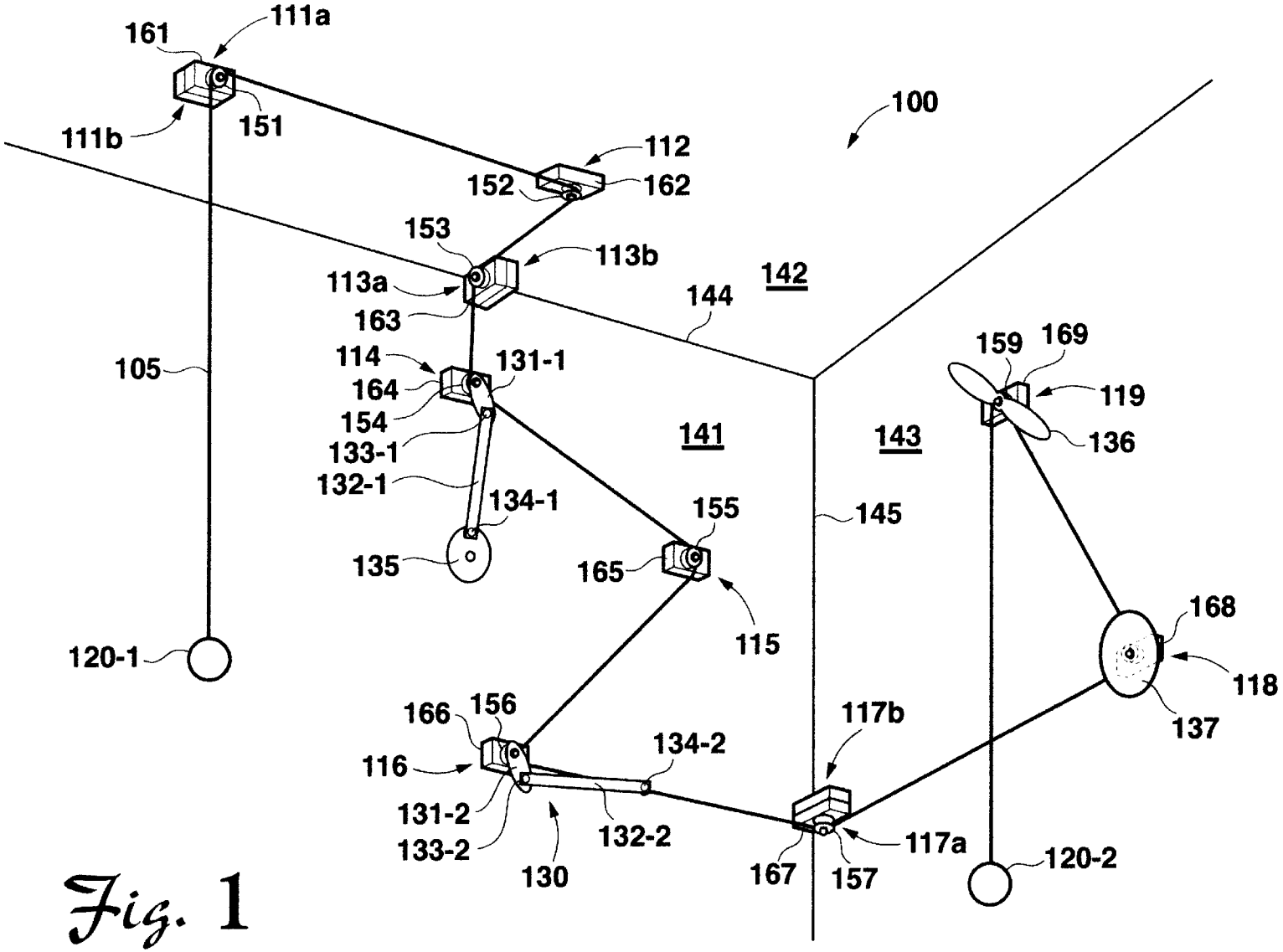
FIG. 1 shows an exemplary configuration of the toy of the present invention.

An exemplary configuration 100 of the toy of the present invention is depicted in FIG. 1. The toy 100 consists of a string 105 which has two handle balls 120-1 and 120-2 attached at the ends thereof, and the string 105 is passed over a series of pulleys 111*a*, 112, 113*a*, 114, 115, 116, 117*a*, 118 and 119. The handle balls 120-1 and 120-2 are preferably between 2.5 cm and 4.4 cm in diameter, and more preferably approximately 3.2 cm in diameter. Pulleys 111*a* and 112 are mounted on ceiling 142. Pulley 113*b* is mounted at the junction 144 of the ceiling 142 and wall 141. Pulleys 114, 115 and 116 are mounted on wall 141. Pulley 117*a* is mounted at the junction 145 of wall 141 and wall 143. Pulleys 118 and 119 are mounted on wall 143. Henceforth, for ease of discussion in the present specification and claims, unless stated or implied otherwise, a "wall" will be the generic term used to mean either a (vertically-oriented) wall or a (horizontally-oriented) ceiling or floor, and these generic walls will have the reference numeral "140".

As discussed in detail below, to enable the path of the string 105 to change planes, pulleys 111*a*, 113*a* and 117*a* are mounted on to the walls 140 on their side surfaces and joined with pulleys 111*b*, 113*b* and 117*b*. Pulleys 111*b*, 113*b* and 117*b* provide reinforcement to the mountings of pulleys 111*a*, 113*a* and 117*a*, respectively, and the actual pulley functionality of pulleys 111*b*, 113*b* and 117*b* is not utilized. All the pulleys 111*a*, 111*b*, 112, 113*a*, 113*b*, 114, 115, 116, 117*a*, 117*b*, 118 and 119 (to be collectively referred to hereinafter using the reference numeral 110) are removably adherable to the vertical walls 141 and 143 and ceiling 142.

Each pulley 110 includes a base block (collective reference numeral: 160) and a pulley wheel (collective reference numeral: 150) rotatably mounted on the base block 160. In particular, visible in FIG. 1 is pulley wheel 151 and base block 161 of pulley 111*a*, pulley wheel 152 and base block 162 of pulley 112, pulley wheel 153 and base block 163 of pulley 113*a*, pulley wheel 154 and base block 164 of pulley 114, pulley wheel 155 and base block 165 of pulley 115, pulley wheel 156 and base block 166 of pulley 116, pulley wheel 157 and base block 167 of pulley 117*a*, base block 168 of pulley 118, and pulley wheel 159 and base block 169 of pulley 119.

Pulley 116 has cam mechanism 130 attached to the pulley wheel 156 thereof. Cam mechanism 130 has a cam arm 131-2 rotatably connected to a cam strut 132-2 at pivot 133-2, and the end of the cam strut 132-2 opposite the pivot 133-2 is slidably mounted at slide mount 134-2 on the string 105. Pulley 114 has cam arm 131-1 attached to the pulley wheel 156. The cam arm 131-1 is rotatably connected to a cam strut 132-1 at pivot 133-1, and the end of the cam strut 132-1 opposite the pivot 133-1 is rotatably connected to disk 135. Pulley 119 has a propeller 136 mounted on the pulley wheel 159 thereof, and pulley 118 has a disk 137 mounted on the pulley wheel (not visible) thereof.

Pulling down on the left-side handle ball 120-1 causes the pulley wheels 150 to rotate, and rotation of the pulley wheels 150 causes movement of the cam mechanism 130, chaotic swinging of the double pendulum formed by the cam strut 132-1 and disk 135, and rotation of the propeller 136 and the disc 137. In particular, pulling down on the left-side handle ball 120-1 causes: pulley wheels 151, 152, and 155 to rotate counter-clockwise; pulley wheels, 153, 154, 156, 157, 159 (and the pulley wheel of pulley 118 which is not visible), cam arms 131-1 and 131-2, disc 137 and propeller 136 to rotate clockwise; cam strut 132-2 to reciprocate along the string 150; and cam strut 132-1 and disk 135, which form a double pendulum system, to swing in a chaotic fashion. Similarly, pulling down on the right-side handle ball 120-2 causes: pulley wheels 151, 152, and 155 to rotate clockwise; pulley wheels, 153, 154, 156, 157, 159 (and the pulley wheel of pulley 118 which is not visible), cam arms 131-1 and 131-2, disc 137 and propeller 136 to rotate counter-clockwise; cam strut 132-2 to reciprocate along the string 150; and cam strut 132-1 and disk 135, which form a double pendulum system, to swing in a chaotic fashion. It should be noted that it is important to assemble the toy in a configuration that will provide tension on the string 105, if the string 105 is to cause the pulley wheels 150 to rotate when it 105 is pulled. This may be accomplished by weighting the distal end (i.e., the end opposite the end which is gripped) of the string 105 with a handle ball 120, by attaching the distal end of the string 105 to a movable object or mechanism, by tying the ends of the string 105 together to form a loop, or simply by having a string of enough weight hanging over the pulley 110. Therefore, when the string is not tied in a loop, the handle balls 120-1 and 120-2 serve two functions. In particular, the handles balls 120-1 and 120-2 provide easily-grippable handles and the weight of the handles balls 120-1 and 120-2 applies a tension to the string 105.

Figure 2A:
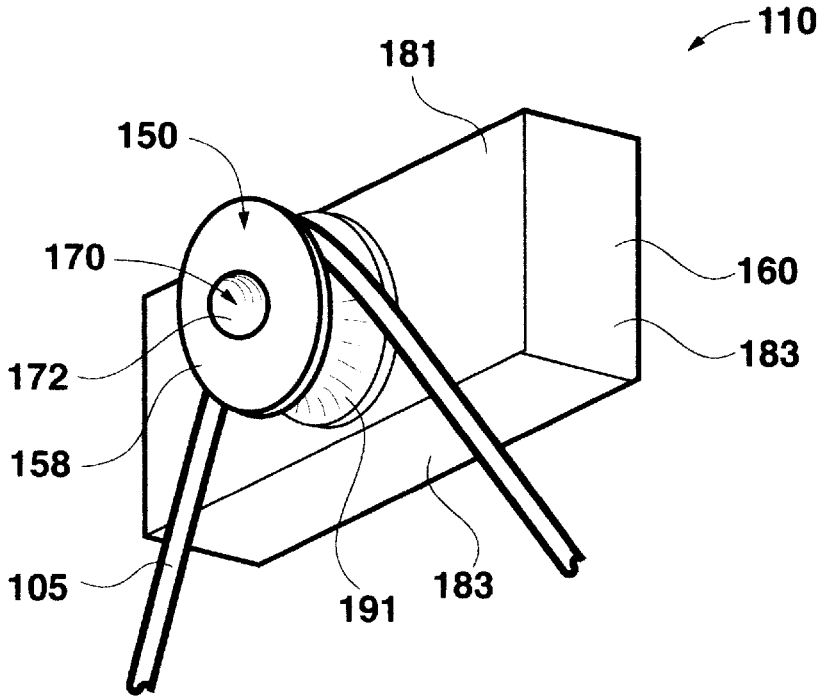
FIG. 2A shows a perspective view of a pulley with a string passing over the pulley wheel.
Figure 2B:
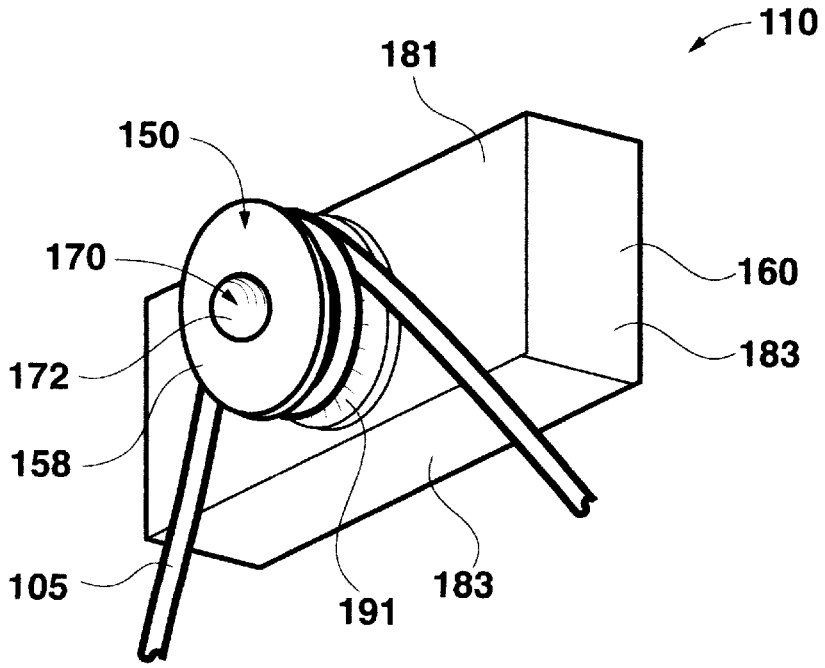
FIG. 2B shows a perspective view of a pulley with a string wrapped once-around the pulley wheel.
Figure 2C:
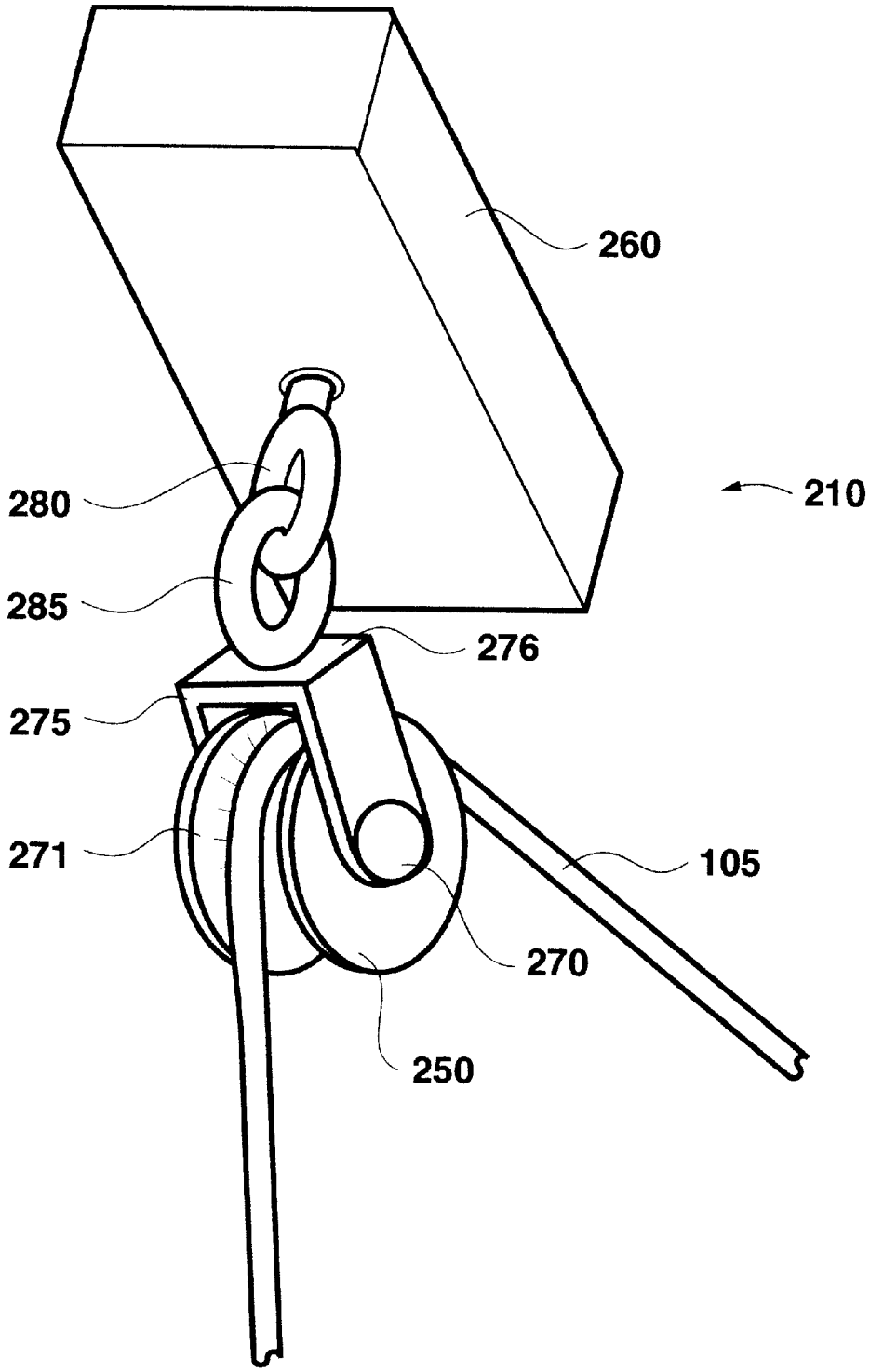
FIG. 2C shows an alternate embodiment of a pulley.
Figure 2D:
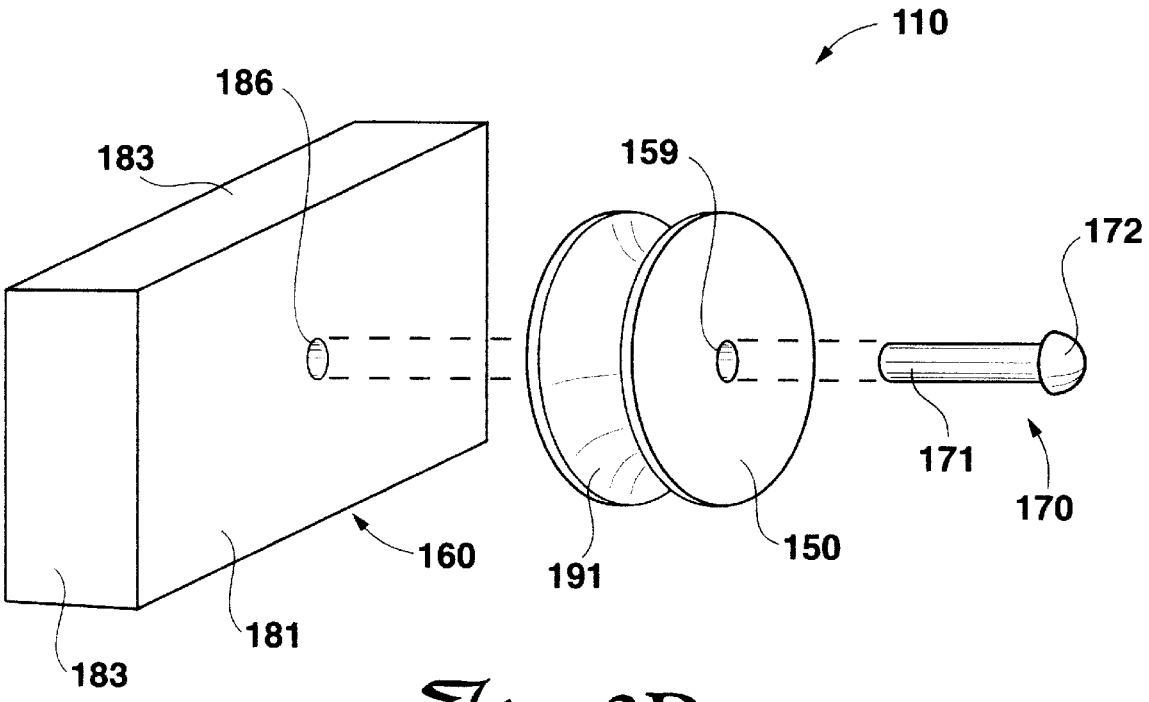
FIG. 2D shows an exploded view of a pulley.

As shown in the exploded view of a pulley 110 of FIG. 2D, the pulley wheel 150 is rotatably mounted on the base block 160 by an axle 170. In the preferred embodiment, the pulley wheel 150, base block 160 and axle 170 are made of wood and are painted bright colors. The axle 170 has a shaft 171 and a head 172, and a throughbore 159 in the pulley wheel 150 is enough wider than the shaft 171 of the axle 170 to allow the pulley wheel 150 to spin freely on the shaft 171. The pulley wheel 150 is mounted on the base block 160 by a friction fit between a well 186 in the front face 181 of the base block 160 and the end of the shaft 171 of the axle 170, or by gluing the end of the shaft 171 into the well 186 in the base block 160.

A close-up perspective view of the assembled pulley 110 with the string 105 passing over a circumferential groove 191 in the pulley wheel 150 is shown in FIG. 2A. The pulley wheel 150 is rotatably mounted on the axle 170 extending from the front surface 181 of the pulley. An alternate engagement of the pulley 110 and string 105 is shown in FIG. 2B where the string 105 is wrapped an additional wind around the pulley wheel 150, i.e., the string is in contact with the circumferential groove 191 of the pulley wheel over a path of more than 360°. The additional area of contact of the string 150 with the groove 191 insures that the pulley wheel 150 will rotate when the string 150 is pulled. This is particularly useful when the pulley wheel 150 drives a mechanism which has substantial internal friction.

Figure 2E:
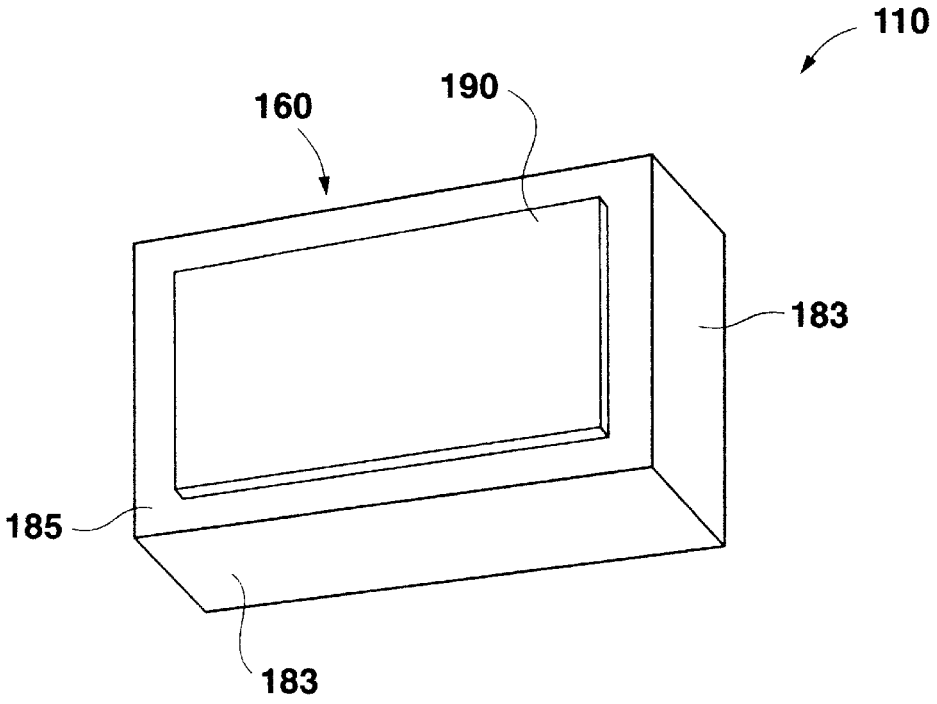
FIG. 2E shows a rear view of a pulley with a patch of double-sided adhesive tape attached to the rear surface.

To attach a base block 160 to a room-environment surface a patch of remountable adhesive tape 190 is affixed to the rear surface 185 of the base block 160, as shown in FIG. 2E. The tape 190 is a flexible, removable pressure-sensitive adhesive tape, where the adhesive has an intermediate adhesive strength so that it will not harm a wall, ceiling or room object when detached therefrom, yet has sufficient adhesive strength to remain attached to the wall, ceiling or room object as the string 105 is pulled over the pulley wheel 150. Preferably, both sides of the tape 190 are remountable, so the tape 190 can be replaced if the outside surface loses its adhesive strength.

Figure 11:
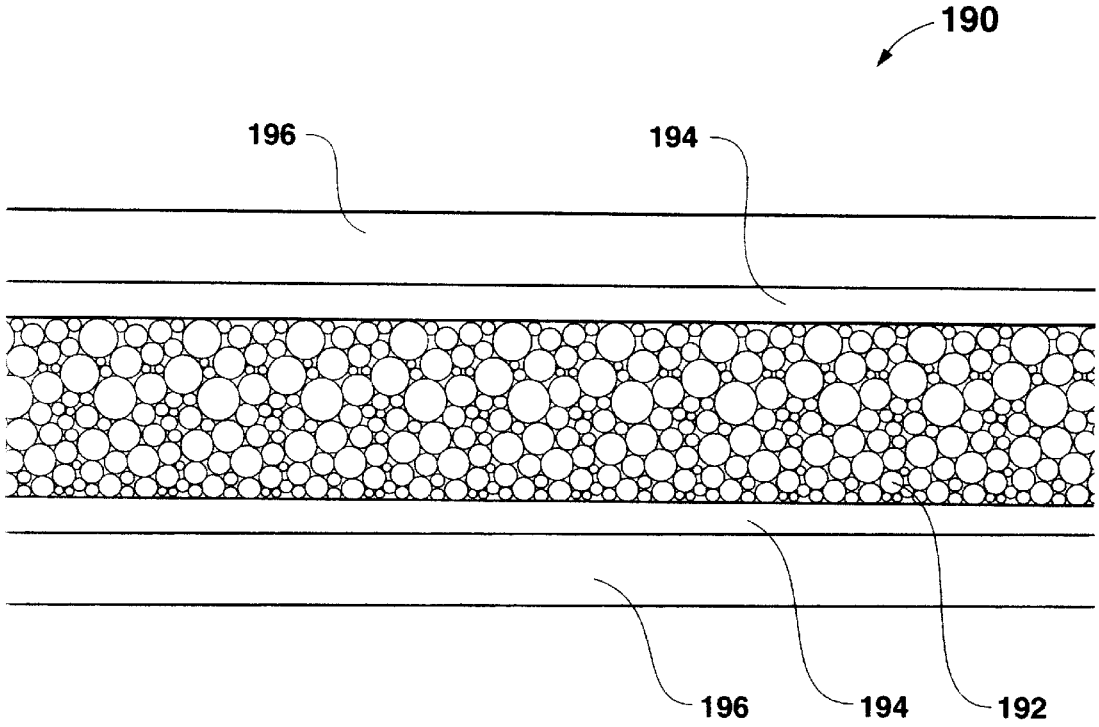
FIG. 11 shows a cross-sectional view of the component layers of the tape.

A cross-sectional view of the component layers of the tape 190 is shown in FIG. 11, with the thicknesses of carrier layers 194 and adhesive layers 196 exaggerated relative to the thickness of a body layer 192 for clarity. According to the present invention, the body 192 of the tape 190 is a foam, preferably an open-cell, ester-grade polyurethane foam having a thickness of approximately 0.16 cm. The advantage of a foam body 192 for the tape 190 is that the displacements caused by short-duration forces applied to the baseblock are absorbed by the foam, and therefore do not act to loosen the grip of the adhesive 196 to the wall 140 or base block 160. The carrier 194 is used to secure the adhesive 196 to the body 192 and prevent migration of the adhesive 196 into the voids in the open-cell foam. In the preferred embodiment the carrier is a polyester having a thickness of approximately 0.0013 cm, and the adhesive 196 is acrylic-based. It should be noted that, in general, cellophane carriers are not sufficiently flexible, and rubber adhesives lose their adhesive strength after repeated attachments to a wall 140. In the preferred embodiment the adhesive tape 190 is item no. 8336, manufactured by MBK Enterprises, Incorporated, of Chatsworth, Calif.

Preferably, the base block 160 is thin (i.e., the depth from the center of the circumferential groove 191 to the back surface 185 is less than, and preferably substantially less than, the distance from the center of the well 186 to an edge of the front face 181) so that the torques produced by the forces applied via the string 105 are not large enough to dislodge the pulley 110 from the wall 140. In the preferred embodiment the base block 160 has a depth of 1.25 cm and the front and rear faces 181 and 185 have dimensions of 2.5 cm×5.0 cm, the pulley wheel 150 has a thickness of 1.25 cm, and the diameter of the circumferential groove 191 is 1.6 cm.

The string 105 must be flexible and have sufficient strength to withstand the applied forces applied to it 105 during construction of and play with the toy. Furthermore, the string 105 must provide sufficient friction with the groove 191 of the pulley wheel 150 to cause the pulley wheel 150 to rotate when the string 105 is pulled over the groove 191. Preferably, the string 105 is a braided synthetic material such as nylon or polypropylene.

As can be seen from FIG. 1, when the back surface 185 of a pulley 110 is mounted on a wall 140, the string 105 must pass across the pulley 110 substantially in the plane of that wall 140. However, at points where the path of the string 105 makes a transition from the plane of a first wall 140 to the plane of a second wall 140, a first side surface 183 of the pulley is attached to the first wall 140 and a second side surface 183 of the pulley is attached to the second wall 140. In particular, in FIG. 1 the string 105 makes a transition from the plane of wall 142 (which in this case is the ceiling 142) to the plane of wall 141 at pulley 113*a*, and a first side surface 183 (side surfaces and back surfaces are not provided with reference numerals in FIG. 1) of pulley 113*a* is attached to wall 142 and a second side surface 183 of the pulley 113*a* is attached to wall 141. Similarly, the string 105 makes a transition from the plane of wall 141 to the plane of wall 143 at pulley 117*a*, and a first side surface 183 of pulley 117*a* is attached to wall 141 and a second side surface 183 of the pulley 117*a* is attached to wall 143. It should be noted that if an end segment of the string 105 is passed over a pulley 110 on the ceiling 142, then that pulley 110 must have its side surface 183 attached to the ceiling 142 if the next pulley 110 along the path of the string 105 is also attached to the ceiling 142. For example, for the configuration of FIG. 1 the end segment of the string 105 is passed over a pulley 111*a* which is on the ceiling 142, and so the side surface 183 of the pulley 111*a* is attached to the ceiling 142 since the next pulley 112 along the path of the string 105 is also attached to the ceiling 142.

Because the side surfaces 183 of the pulleys 110 have a smaller surface area than the back surfaces 185 of the pulleys 110, when a first pulley 110 has its side surface 183 attached to a wall 140, it is advantageous to attach a second pulley 110 to the first pulley 110 so that the side surface 183 of the second pulley is also attached to the wall 140, thereby increasing the strength of the attachment to the wall 140 at that point along the path of the string 105. Similarly, when a first pulley 10 has two of its side surfaces 183 attached to a pair of walls 140 which meet, it is advantageous to attach a second pulley 110 to the first pulley 110 so that two of the side surfaces 183 of the second pulley are also attached to the walls 140, thereby increasing the strength of the attachment to the walls 140 at that point along the path of the string 105. For instance, the back surfaces 185 of pulleys 111*a* and 111*b* are attached together, and side surfaces 183 of both pulleys 111*a* and 111*b* are attached to the ceiling 142 with removable adhesive tape 190. Similarly, the back surfaces 185 of pulleys 113*a* and 113*b* are attached together and side surfaces 183 of both pulleys 113*a* and 113*b* are attached to the ceiling 142 and wall 141, and the back surfaces 185 of pulleys 117*a* and 117*b* are attached together and side surfaces 183 of both pulleys 113*a* and 113*b* are attached to walls 141 and 143.

An alternate embodiment of the pulley 210 shown in FIG. 2 is designed so that the plane of a circumferential groove 271 in a pulley wheel 250 is orientable at a range of angles relative to the wall 140 to which the base block 260 is attached. In this embodiment the pulley wheel 250 is rotatably mounted on an axle 270 attached to a U-bracket 275. A first eyelet 280 mounted on the base block 260 passes through the aperture of a second eyelet 285 mounted on the base 276 of the U-bracket 275. Preferably, either the first eyelet 280 is rotatably mounted on the base block 260 or the second eyelet 285 is rotatably mounted on the base 276 of the U-bracket 275 so as to provide additional freedom to the orientation of the pulley wheel 250.

Figure 3A:
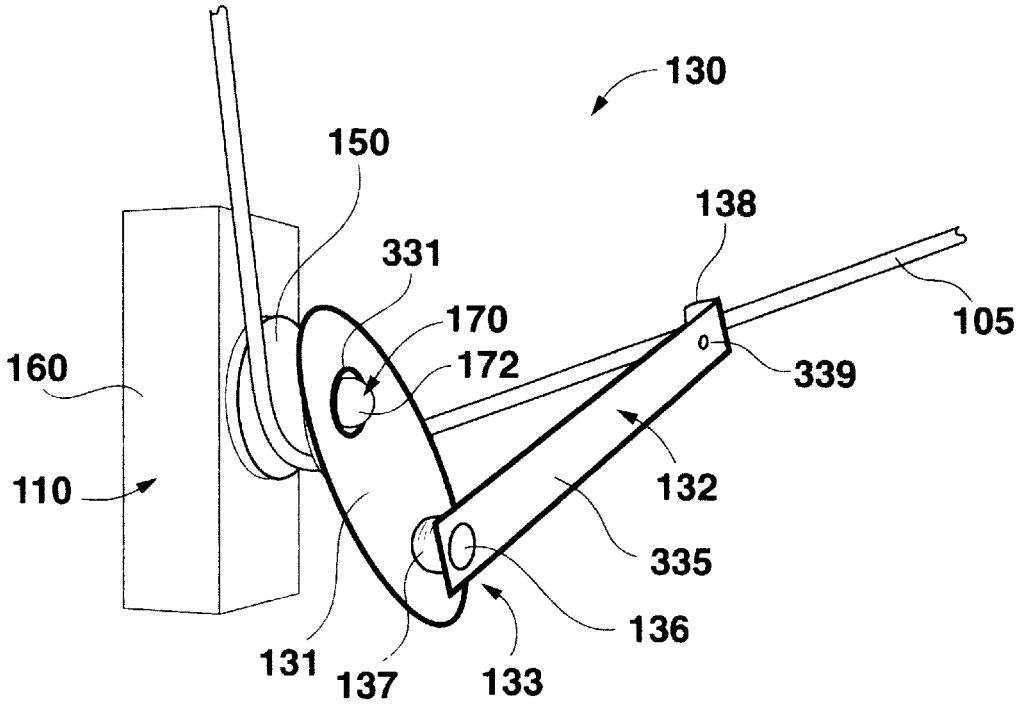
FIG. 3A shows a close-up perspective view of a cam mechanism.
Figure 3B:
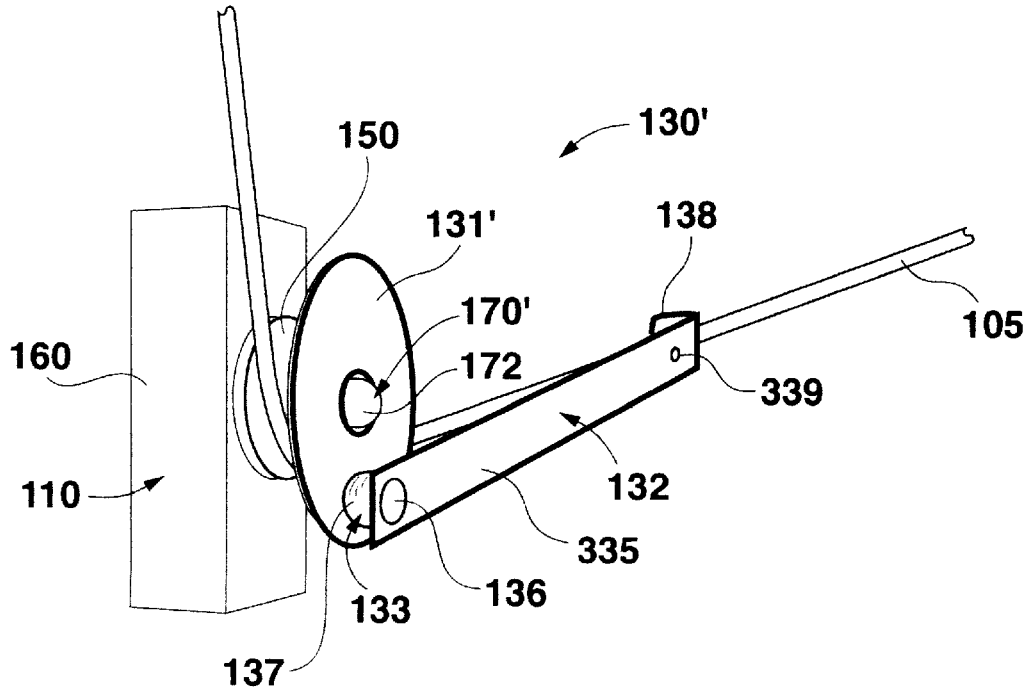
FIG. 3B shows a close-up perspective view of a variation of the cam mechanism.
Figure 3C:
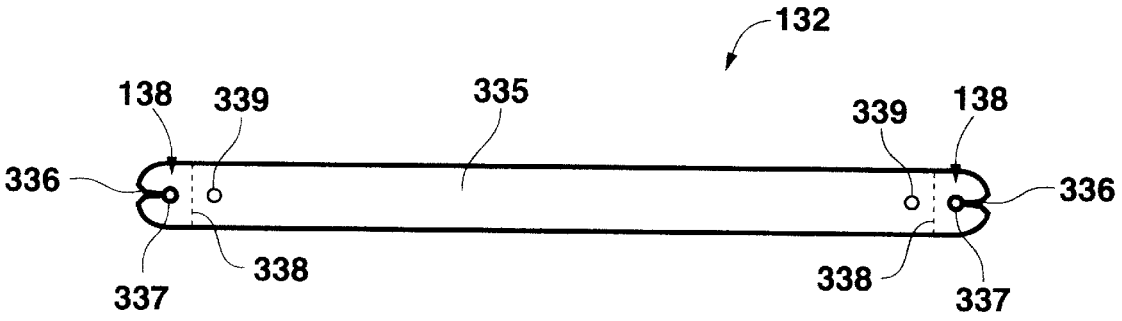
FIG. 3C shows the cutout shape of the strut arm of the cam mechanism of FIGS. 3A and 3B.
Figure 3D:
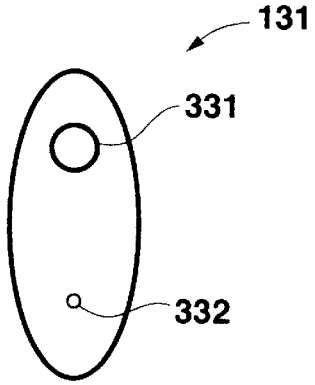
FIG. 3D shows the cutout shape of the cam arm of the cam mechanism of FIG. 3A.
Figure 3E:
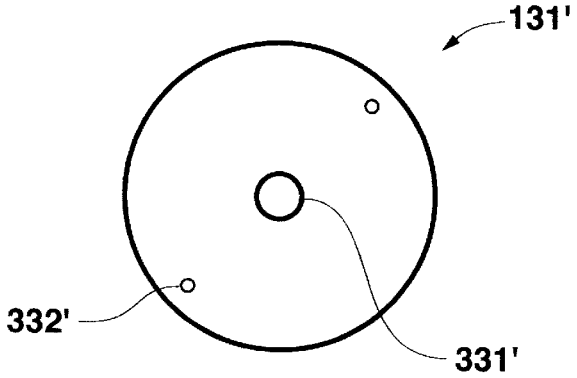
FIG. 3E shows the cutout shape of the cam arm of the cam mechanism of FIG. 3B.
Figure 3F:
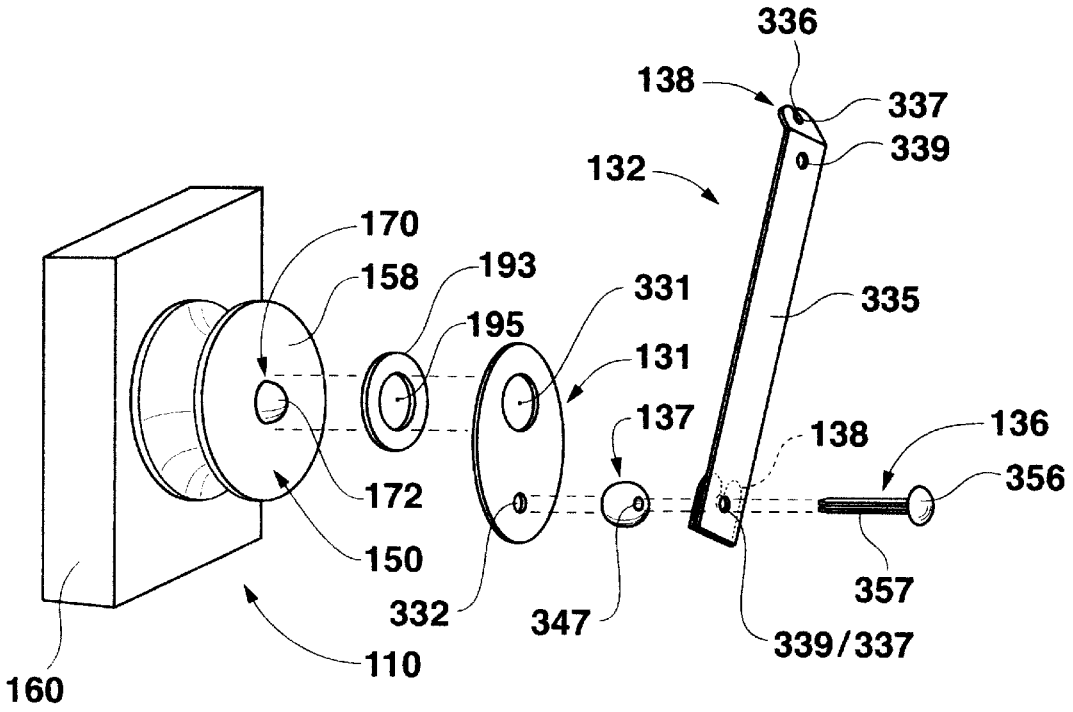
FIG. 3F shows an exploded view of the cam mechanism of FIG. 3A.

A perspective view of a cam mechanism 130 attached to a pulley 110 and string 105 is shown in FIG. 3A, and an exploded view of the cam mechanism 130 is shown in FIG. 3F. In the preferred embodiment the cam arm 131 is constructed from a stiff planar material and has the shape shown in FIG. 3D, and the cam strut 132 is constructed from a stiff, but foldable, planar material and has the shape shown in FIG. 3C. Such stiff planar materials include cardboard, chipboard, stiff paper, wood, metal, plastic, plastic-coated paper, etc. The cam arm 131 is substantially ellipsoidal in shape and has a larger cam aperture 331 near a first focus of the ellipsoid and a smaller cam aperture 332 near a second focus of the ellipsoid. The cam strut 132 has a elongated central section 335 with two body holes 339 near each end, nibs 138 extending from each end of the elongated central section 335, and fold scores 338 defining the boundaries of the nibs 138 and the elongated central section 335. Each nib 138 of the strut arm 132 has a nib hole 337 therethrough, and a slit 336 extending from the outside end of the nib 138 to the nib hole 337.

Figure 3G:
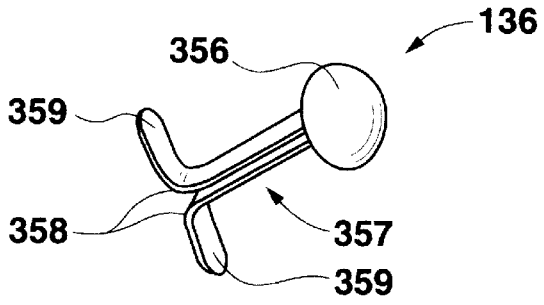
FIG. 3G shows a removable rivet with the legs bent in the configuration which secures the pivot of a cam mechanism.

As shown in FIG. 3F, the cam arm 131 is mounted to the outside surface 158 of the pulley wheel 150 with the larger cam aperture 331 encircling the head 172 of the axle 170 using a ring of double-sided removable tape 193 which is mounted on the outside surface 158 of the pulley wheel 150 so that its central aperture 195 encircles of the head 172 of the axle 170. The nib 138 at the lower end of the cam strut 132 (shown as a dotted line to indicate that a view of it 138 is obscured by the central section 335 of the cam strut 132) is folded back onto the central section 335 of the cam strut 132 at fold score 338 so that the nib hole 337 overlaps the body hole 339. The cam strut 132 is rotatably mounted to the cam arm 131 with a removable rivet 136. In the preferred embodiment the removable rivet 136 (and the other removable rivets discussed below for other mechanisms) is a round-head brass paper fastener having a rivet head 356 and a pair of bendable rivet legs 357. The legs 357 of the removable rivet 136 pass through a body hole 339 in the strut arm 132, nib hole 337 in the nib 138, a central bore 347 in a spherical wooden bead 137, and the smaller cam aperture 332 in the cam arm 131, and the portions 359 of the legs 357 extending past the cam arm 131 are bent at right angles at bend points 358 to secure the pivot 133, as shown in FIG. 3G. The extra layer of material produced by folding the nib 138 back onto the central section 335 of the cam strut 132 where the cam strut 132 is attached to the cam arm 131 provides reinforcement and reduces the likelihood of failure due to wear and tear. The distance from the head 356 of the rivet 136 to the bend points 358 is slightly greater than the combined width of the wooden bead 137 and the thicknesses of the cam arm 131, the nib 138 and the central section 335 of the cam strut 132, so the head 356 of the removable rivet 136 and the end portions 359 of the legs 357 sandwich the cam arm 131, cam strut 132 and wooden bead 137 loosely enough that the cam strut 132 is rotatable relative to the cam arm 131, thereby forming pivot 133. The nib 138 at the end of the cam strut 132 opposite the end mounted to the cam arm 131 is folded at an angle of approximately 90° relative to the longitudinal axis of the central section 335, and mounted to the string 105 by sliding the string 105 through the slit 336 so the string 105 passes through the nib hole 337.

Figure 4A:
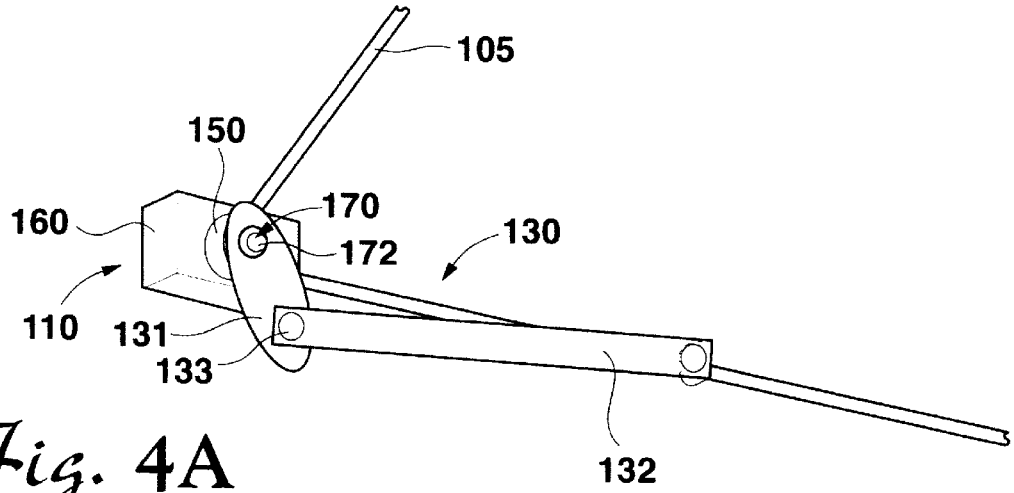
FIGS. 4A–C show a series of views of the cam mechanism illustrating its motion as the string is pulled.
Figure 4B:
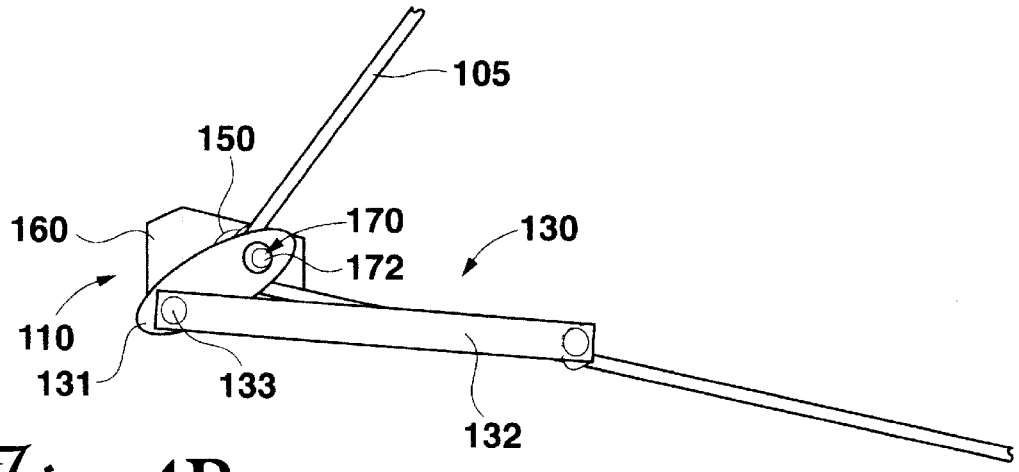
Figure 4C:
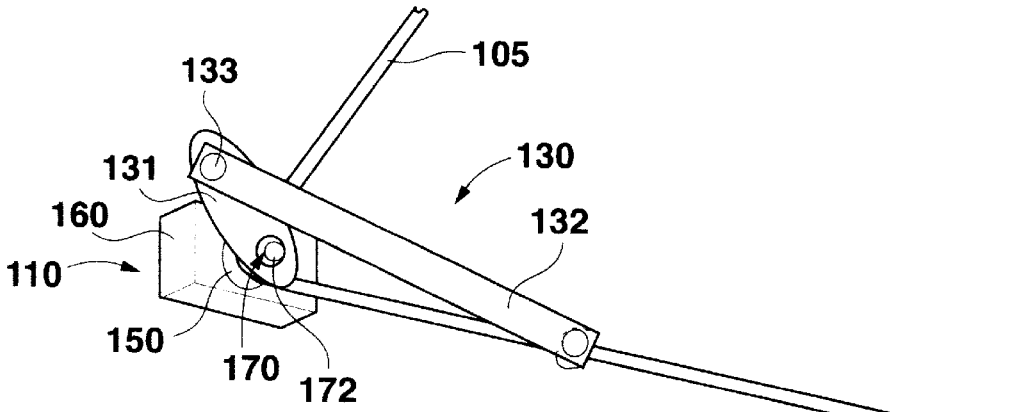

As illustrated by the sequence of FIGS. 4A, 4B and 4C, as the string 105 is pulled the cam arm 131 rotates and the strut 132 reciprocates back and forth. In FIG. 4A the cam mechanism 130 is depicted with the longitudinal axis of the cam arm 131 projecting downwards and to the right relative to the axle 170 of the pulley 110. As the top section of the string 105 is pulled upwards the pulley wheel 150 will rotate clockwise and the cam arm 131 will also rotate clockwise and, as shown in FIG. 4B, the cam arm 131 will come to an orientation with its longitudinal axis projecting downwards and to the left relative to the axle 170. In the motion of the cam mechanism 130 from the state of FIG. 4A to the state of FIG. 4B, the outside end of the cam arm 131 (i.e., the end where the pivot is located) has moved leftwards, and this has caused the strut 132 to also move leftwards. As the top section of the string 105 is pulled farther upwards the pulley wheel 150 will continue to rotate clockwise and the cam arm 131 will also continue to rotate clockwise and, as shown in FIG. 4C, the cam arm 131 will come to an orientation with its longitudinal axis projecting upwards and to the left relative to the axle 170. In the motion of the cam mechanism 130 from the state of FIG. 4B to the state of FIG. 4C, the outside end of the cam arm 131 has moved upwards, and this has caused the center of the strut 132 to also move upwards. Then, as the string 105 is pulled farther upwards the pulley wheel 150 and cam arm 131 continue to rotate clockwise, and the cam arm 131 will come to return to the orientation of FIG. 4A. In the motion of the cam mechanism 130 from the state of FIG. 4C to the state of FIG. 4A, the outside end of the cam arm 131 has moved downwards and rightwards, causing the center of the strut 132 to also move downwards and rightwards.

It should be understood that the purpose of the wooden bead 137 in the cam mechanism 131 discussed above and the other mechanisms discussed below is to reduce the friction at pivot points between rotating components. Furthermore, the separation provided by the bead 137 prevents the edges of the components from abutting as the components rotate about the pivot point relative to one another. Workable mechanisms constructed without such beads are to be considered within the scope of the present invention. Furthermore, other rotatable pivot mechanisms, such as metal rivets, plastic rivets, bearings, the rivet described above with the substitution of a plastic bead for the wood bead, and so on, are also to be considered within the scope of the present invention.

A perspective view of an alternate embodiment of a cam mechanism 130' having a circular cam arm 131' is shown in FIG. 3B. The cam arm 131' is constructed from a stiff planar material, and the cam strut 132 is constructed from a stiff, but foldable, planar material. Such stiff planar materials include cardboard, chipboard, stiff paper, metal, plastic, plastic-coated paper, etc. The cam strut 132 has the shape discussed above in reference to the cam mechanism 130 of FIG. 3A having an ellipsoidal cam arm 131. As shown in FIG. 3E, the cam arm 131' is substantially circular in shape and has a larger cam aperture 331' at its center and a smaller cam aperture 332' near the outside edge. As shown in FIG. 3B, the cam arm 131' is mounted to the outside surface of the pulley wheel 150 with the larger cam aperture 331' encircling the head 172 of the axle 170 using a ring of double-sided removable tape (not visible) in the same manner as discussed for the cam mechanism 130 of FIG. 3A. As discussed above for the cam mechanism 130 of FIG. 3A, the cam strut 132 is rotatably mounted to the cam arm 131' with a removable rivet 136 through the small cam aperture 332', and the string 105 passes through a nib hole 337 in the nib 138 thereby slidably mounting the cam strut 132 to the string 105. It should be understood that a circular cam arm 131' can generally be substituted for an ellipsoidal cam arm 131, and vice versa, in any mechanism requiring a cam arm.

Figure 5A:
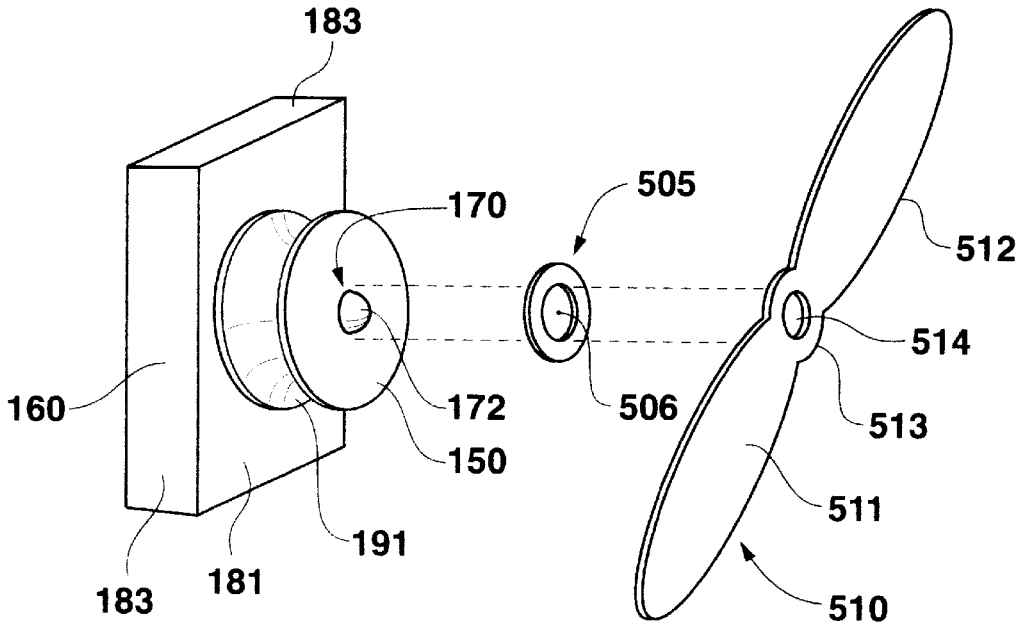
FIG. 5A shows an exploded view of the attachment of a propeller cutout to a pulley.
Figure 5B:
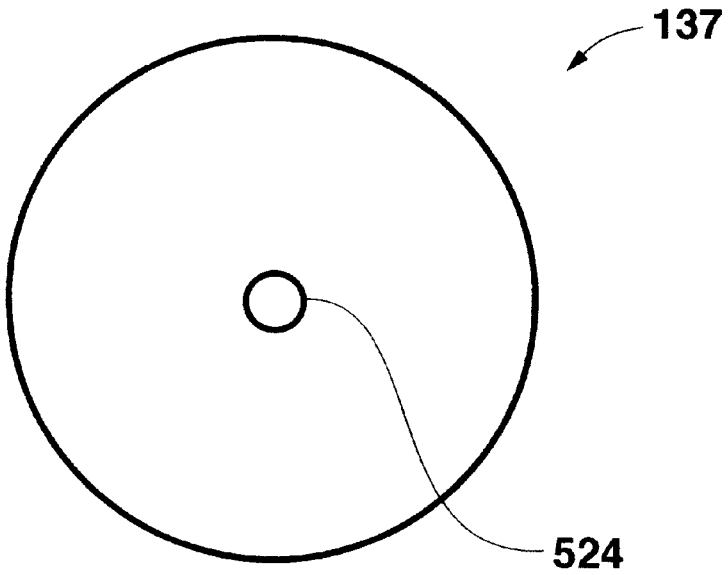
FIG. 5B shows a close-up of a disk cutout.
Figure 5C:
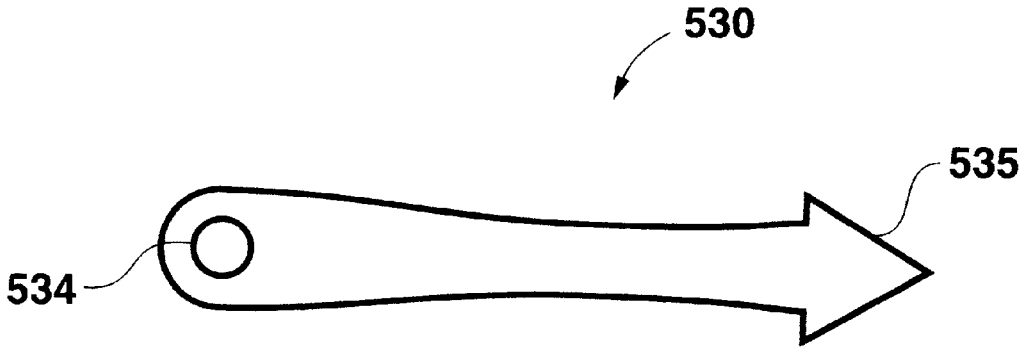
FIG. 5C shows a close-ups of a clock hand cutout.

According to the present invention, planar elements and non-planar elements, including mechanical mechanisms, may be affixed to the pulley wheels 150 of the pulleys 110 to provide visually interesting displays or to perform mechanical functions—even useful mechanical functions such as the manipulation of room objects. FIGS. 5A through 5C depict planar elements that may be affixed to the outside surface of the pulley wheels 150. The planar elements may be made of any relatively stiff material such as cardboard, chipboard, stiff paper, wood, plastic, metal, etc., and may be provided to the consumer ready for use or may be supplied as outlines on a sheet which the consumer must cut out.

As depicted in the exploded view of FIG. 5A, attachment of a planar object, in this case a propeller 510, is accomplished using a planar double-sided tape ring 505. In the preferred embodiment the double-sided tape is MBK Enterprises brand, item #8336. The tape ring 505 has an interior circular aperture 506 which has a diameter slightly larger than the diameter of the head 172 of the axle 170. (It is to be understood that the other tape rings mentioned in the present specification also share the properties discussed above in reference to the tape ring 505 of FIG. 5A.) Although it is not a requirement, the elements for attachment to the pulley wheels 110 described in the present specification also have circular apertures which interior diameters slightly larger than the heads 172 of the axles 170 of the pulleys 110. In the case of FIG. 5A, the propeller 510 has a aperture 514 through a central hub 513 and two blades 511 and 512 extend outwards from the hub 513. Attachment is accomplished by affixing the tape ring 505 to the planar surface of the pulley wheel 150 encircling the head 172 of the axle 170, and affixing the hub 513 of the propeller 510 to the tape ring 505 and therefore the pulley wheel 150. Similarly, the disk 137 of FIG. 1, shown in a close-up view in FIG. 5B, has a central circular aperture 524 which is slightly larger than the heads 172 of the axles 170. Again, attachment is accomplished by affixing a tape ring 505 to the planar surface of the pulley wheel 150 encircling the head 172 of the axle 170, and affixing the area around the central aperture 524 to the tape ring 505 and therefore the pulley wheel 150. Another planar cutout which produces a fanciful appearance is the clock hand 530 shown in close-up in FIG. 5C. The clock hand 530 has an arrow head 535 at one end and a circular aperture 534 which is slightly larger than the heads 172 of the axles 170. The clock hand 530 may be attached to a pulley wheel 150 in the same manner as discussed above for the disk 137 of FIG. 5B.

Figure 10:
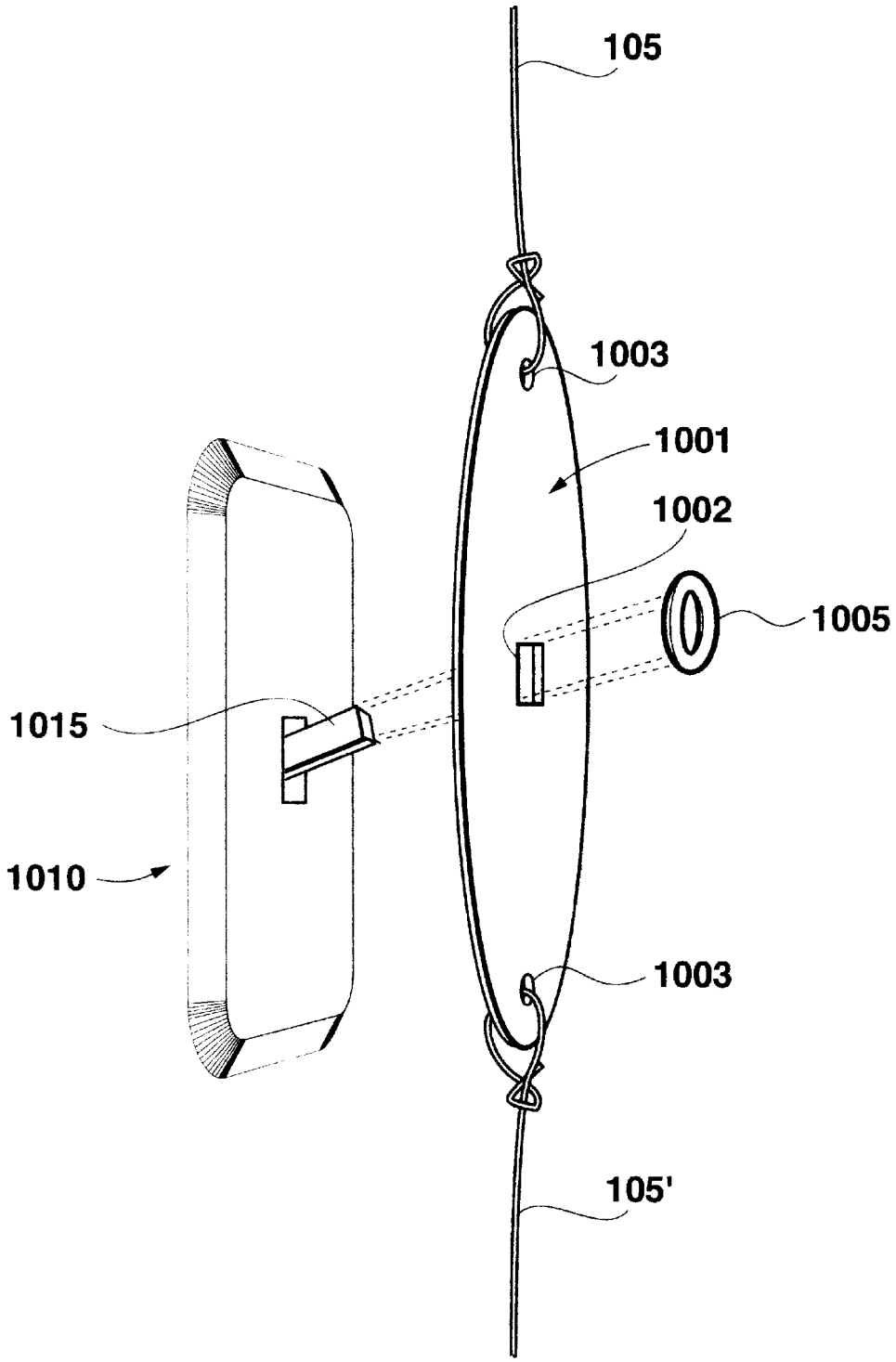
FIG. 10 is an exploded view showing how a light switch engagement cutout is attached to a light switch.

As shown in the exploded view of FIG. 10, the preferred embodiment of the present invention also includes a light switch engagement cutout 1001 which may be attached to the throw knob 1015 of a light switch 1010 to allow the throw knob 1015 to be thrown remotely. The light switch engagement cutout 1001 has an ellipsoidal shape, a small hole 1003 at each end thereof, and a central square aperture 1002 with a size slightly greater than the cross-sectional dimension of a standard light switch throw knob 1015. The light switch engagement cutout 1001 is engaged with the light switch 1010 by inserting the throw knob 1015 through the square aperture 1002 and securing the engagement cutout 1001 to the throw knob 1015 by putting a rubber grommet 1005 with an interior-diameter of approximately 0.6 cm over the end of the throw knob 1015. The string 105 is attached to the engagement cutout 1001 by passing the string 105 through the upper hole 1003 and tying the string 105 to itself 105. Then, if the throw knob 1015 is in the downwards position, pulling on the string 105 will move the throw knob 1015 to the upwards position. Similarly, if a second string 105' is attached to the engagement cutout 1001 by passing the second string 105' through the lower hole 1003 and tying the string 105' to itself 105', the throw knob 1015 can also be moved from the upwards position to the downwards position.

Another useful function which can be performed by the present invention is the opening and/or closing of a door, cabinet, drawer, etc. This may be accomplished by tying an end of the string 105 directly to the door, cabinet or drawer. Alternatively, this may be accomplished by attaching a cutout or a pulley, which is attached to the string, to the door, cabinet or drawer with the removably double-sided tape.

Figure 6:
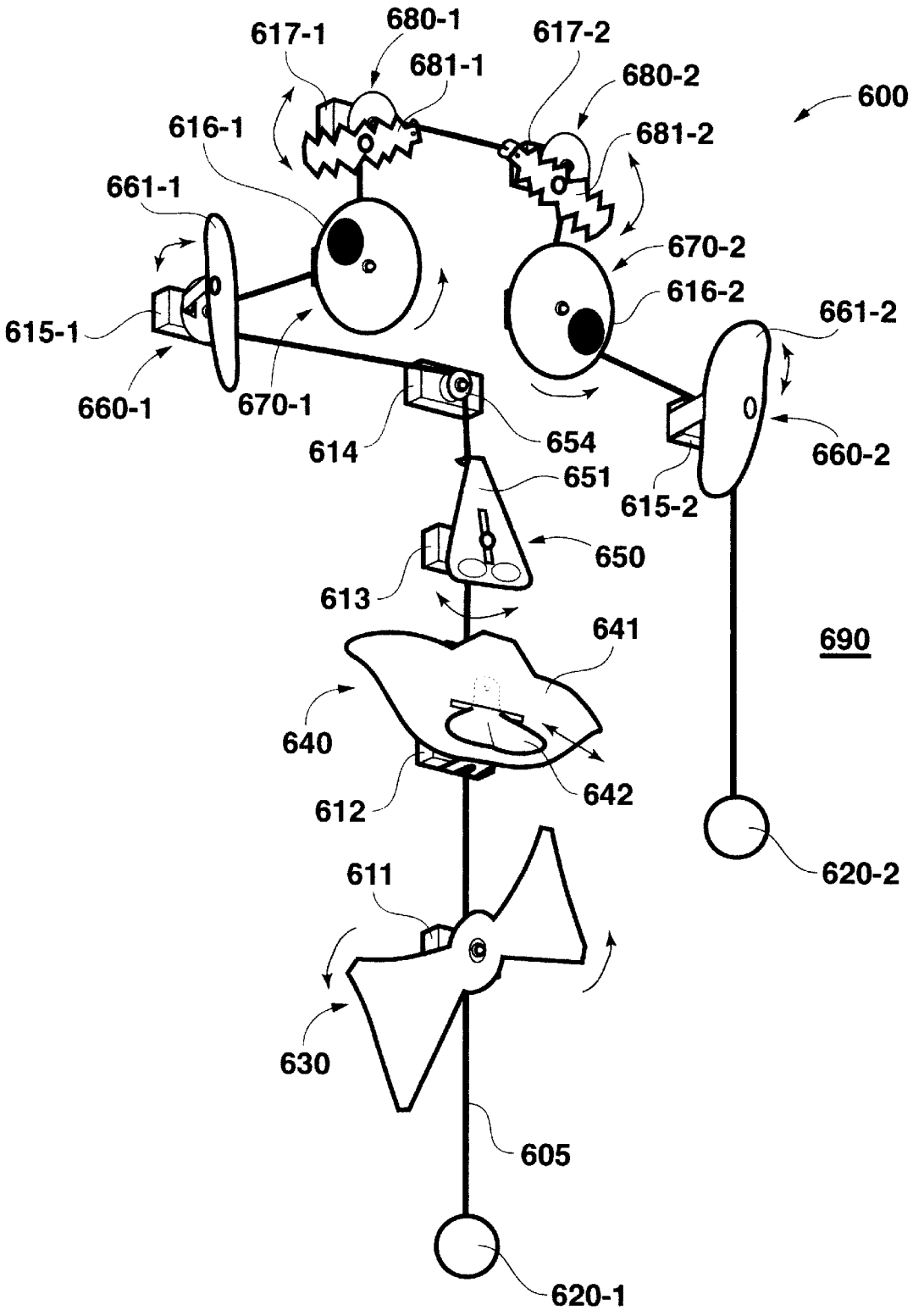
FIG. 6 depicts an alternate embodiment of the present invention where the cutout elements attached to the pulleys depict a cartoon face.

FIG. 6 depicts an alternate embodiment of the present invention where the cutout elements attached to the pulleys 110 depict a cartoon face. In particular, a first handle ball 620-1 is attached at a first end of the string 105 and a second handle ball 620-2 is attached at a second end of the string 105. Pulleys 611, 612, 613, 614, 615-1, 615-2, 616-1, 616-2, 617-1 and 617-2 are mounted on a wall 690, and the string 105 passes in sequence around the pulley wheel (not visible) of pulley 611, the pulley wheel (not visible) of pulley 612, the pulley wheel (not visible) of pulley 613, the pulley wheel 654 of pulley 614, the pulley wheel (not visible) of pulley 615-1, the pulley wheel (not visible) of pulley 616-1, the pulley wheel (not visible) of pulley 617-1, the pulley wheel (not visible) of pulley 617-2, the pulley wheel (not visible) of pulley 616-2, and the pulley wheel (not visible) of pulley 615-2. Mounted on the pulley wheel of pulley 611 is a bowtie-shaped cutout 630 which rotates as the pulley wheel rotates. Mounted on pulley 612 is a mouth-and-tongue mechanism 640 which performs a protruding and retracting of the tongue element 642 as the pulley wheel rotates. Mounted on pulley 613 is a first swinging-motion mechanism 640 which performs a swinging of the nose cutout 651 in the plane of the wall 690 as the pulley wheel rotates. Mounted on pulleys 615-1 and 615-2 are second swinging-motion mechanisms 660-1 and 660-2 which perform a swinging of the ear cutouts 661-1 and 661-2 in the plane perpendicular to the wall 690 as the pulley wheel rotates. Mounted on pulleys 616-1 and 616-2 are disks 670-1 and 670-2 representing eyes which rotate as the pulley wheel rotates, producing a goofy appearance because the eyeballs 671-1 and 671-2 are located off-center on the disks 670-1 and 670-2. Mounted on pulleys 617-1 and 617-2 are eyebrow mechanisms 670-1 and 670-2 which perform a reciprocation of the eyebrow cutouts 681-1 and 681-2 as the pulley wheels rotate using the cam mechanism 130' of FIG. 3B.

Figure 7A:
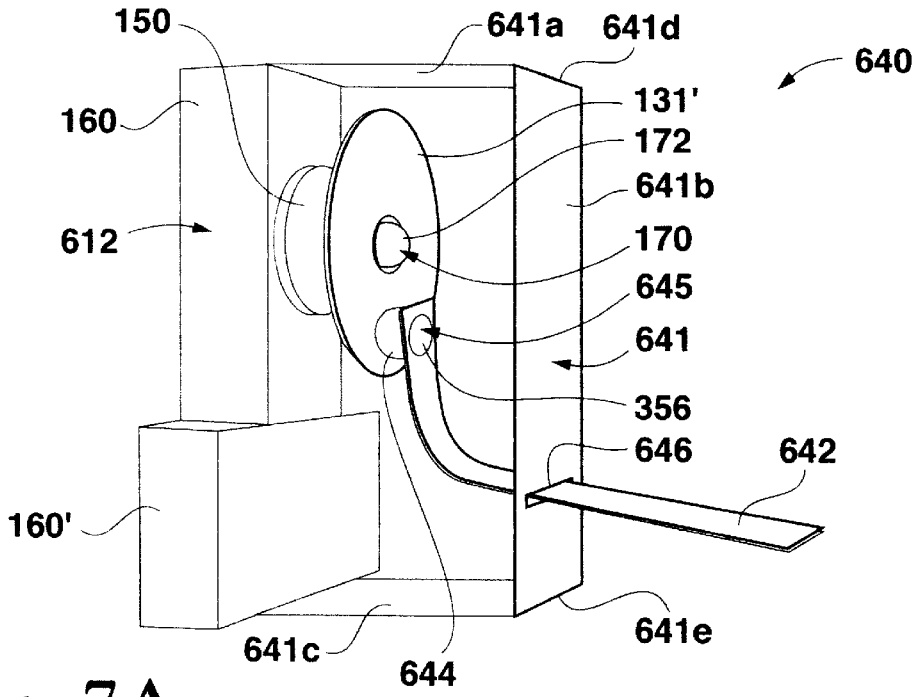
FIGS. 7A and 7B depict two configurations of a tongue-and-mouth mechanism which converts rotational motion in a first plane to a reciprocating motion in a second plane perpendicular to the first plane.
Figure 7B:
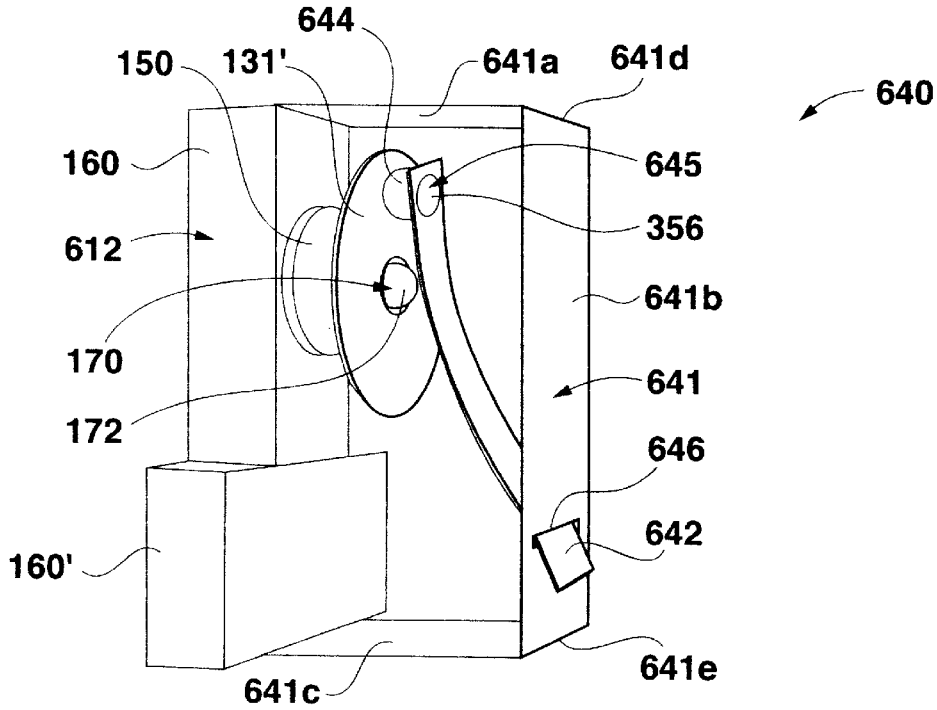

Close-up perspective views of the mouth-and-tongue mechanism 640 are shown in FIGS. 7A and 7B. For ease of representation and clarity the housing 641 and tongue element 642 are depicted as rectangular in shape. However, it should be understood that the housing 641 and tongue element 642 may have a wide variety of shapes so as to depict a wide range of objects, whether realistic or fanciful, such as the mouth 640 of FIG. 6. The housing 641 has a top section 641*a* which is attached to the upper side surface 183 of an upper, vertically-oriented base block 160 using double-sided adhesive tape (not visible) and projects horizontally therefrom, a bottom section 641*c* which is attached to the bottom side surface 183 of a lower, horizontally-oriented base block 160' using adhesive tape (not visible) and projects horizontally therefrom, and a vertically oriented front section 641*b* connecting the top and bottom sections 641*a* and 641*c* at folds 641*d* and 641*e*. The tongue element 642 extends through a slit 646 in the front section 641*b* of the housing 641. A circular cam arm 131' is mounted on the front surface of the pulley wheel 150 such that the central aperture 331' (see FIG. 3E) in the circular cam arm 131' is centered around the head 172 of the pulley axle 170. The tongue element 642 is mounted to the circular cam arm 131' using a removable rivet 645 which passes through a hole (not visible) in the tongue element 642, a bore 347 (see the bead 137 of FIG. 3F) in a wooden bead 644, and the small hole 332' in the circular cam arm 131'. The ends 359 of the legs 357 of the rivet 645 are bent outwards (see FIG. 3G) so that the head 356 and the outer ends 359 of the legs 357 of the rivet 645 sandwich the bead 644 between the circular cam arm 131' and the tongue element 642 loosely enough that tongue element 642 is free to rotate relative to the circular cam arm 131'.

As shown by the sequence of depictions of FIGS. 7A and 7B, as the pulley wheel 150 rotates, the tongue element 642 protrudes and retracts through the slit 646 in the front section 641*b* of the housing 641. In particular, when the circular cam arm 131' is oriented so that the bead 644 is at the bottom of the circular cam arm 131' as shown in FIG. 7A, the distance from the bead 644 to the slit 646 is at a minimum, so the tongue 642 protrudes by a maximum amount through the slit 646. As the circular cam arm 131' rotates and the bead 644 moves upwards, the distance from the bead 644 to the slit 646 is reduced, so extent to which the tongue 642 protrudes through the slit 646 is reduced. And when the circular cam arm 131' is oriented so that the bead 644 is at the top of the circular cam arm 131' as shown in FIG. 7B, the distance from the bead 644 to the slit 646 is at a maximum, so the tongue 642 protrudes by a minimum amount through the slit 646. This tongue-and-mouth mechanism 640 is therefore an example of a mechanism which converts rotational motion in a first plane to a reciprocating motion in a second plane perpendicular to the first plane.

Figure 8A:
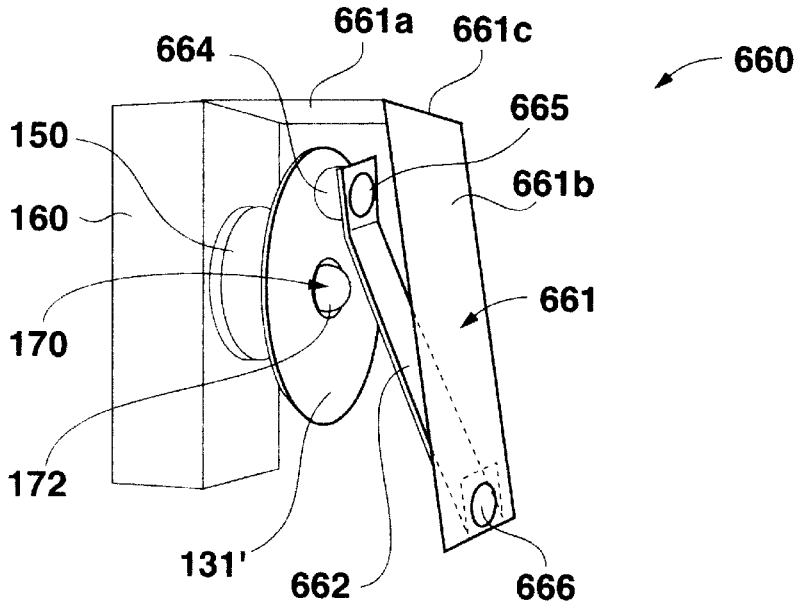
FIGS. 8A and 8B depict two configurations of a swinging-motion mechanism which converts rotational motion in a first plane to a swinging motion in a second plane perpendicular to the first plane.
Figure 8B:
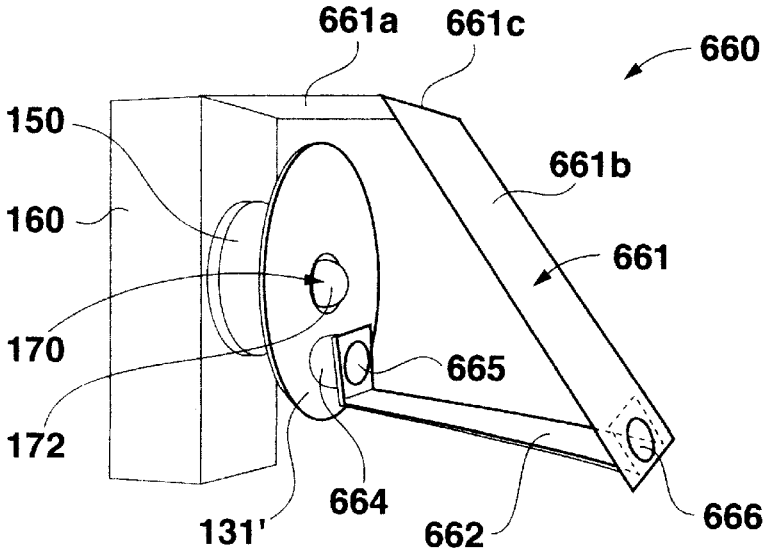

Close-up perspective views of a swinging-motion mechanism 660 which is used to animate the ears 660-1 and 660-2 are shown in FIGS. 8A and 8B. The flap 661 is made of cardboard or chipboard, and is folded at fold 661*c* to form a flap roof 661*a* and a flap wing 661*b*. For ease of representation and clarity the flap wing 661*b* is depicted as a rectangular element. However, it should be understood that the flap wing 661*b* may have a wide variety of shapes so as to depict a wide range of objects, whether realistic or fanciful, such as the ears 660 shown in FIG. 6. The flap roof 661*a* is attached to the upper side surface 183 of the base block 160 using adhesive tape (not visible) and projects horizontally therefrom, and the flap wing 661*b* connects to the flap roof 661*b* at the outside end of the flap roof 661*b*, and extends downwards therefrom. A circular cam arm 131' (see FIG. 3E) is mounted on the front surface of the pulley wheel 150 such that the central aperture 331' in the circular cam arm 131' is centered around the head 172 of the pulley axle 170. A piston 662 made of cardboard or chipboard is rotatably mounted to the circular cam arm 131' using a removable rivet 665 and a wooden bead 664, where the head 356 of the rivet 665 and the ends 359 of the legs 357 which are bent at 90° to the sections of the legs 357 attached to the head 356 (see FIG. 3G) sandwich the bead 664 between the circular cam arm 131' and the piston 662. The piston 662 is rotatably secured to the bottom edge of the flap wing 661 by a second removable rivet 666 which passes through aligned holes (not visible) in the flap wing 661 and the piston 662. The contact of the head 356 and the ends 359 of the legs 357 of the removable rivet 665, circular cam arm 131', bead 664 and piston 665 is made loose enough that rotation of the piston 662 relative to the circular cam arm 131' is possible.

As shown by the sequence of depictions of FIGS. 8A and 8B, as the pulley wheel 150 rotates, the bottom of the flap wing 661*b* repeatedly swings away from the circular cam arm 131' and back towards it 131', pivoting about the fold 661*c* between it 661*b* and the flap roof 661*a*. In particular, when the circular cam arm 131' is oriented so that the bead 664 is at the bottom of the circular cam arm 131' as shown in FIG. 5B, the piston 662 is oriented horizontally, so the bottom of the flap wing 661*b* is a maximum distance from the circular cam arm 131'. As the circular cam arm 131' rotates and the bead 664 moves upwards, the orientation of the piston 662 becomes less horizontal, and the distance of the bottom of the flap wing 661*b* from the circular cam arm 131' decreases. And when the circular cam arm 131' is oriented so that the bead 664 is at the top of the circular cam arm 131' as shown in FIG. 8A, the piston 662 is at its most vertical orientation, so the bottom of the flap wing 661*b* is a minimum distance from the circular cam arm 131'. This swinging-motion mechanism 660 is therefore an example of a mechanism which converts rotational motion in a first plane to a swinging motion in a second plane perpendicular to the first plane.

Figure 9A:
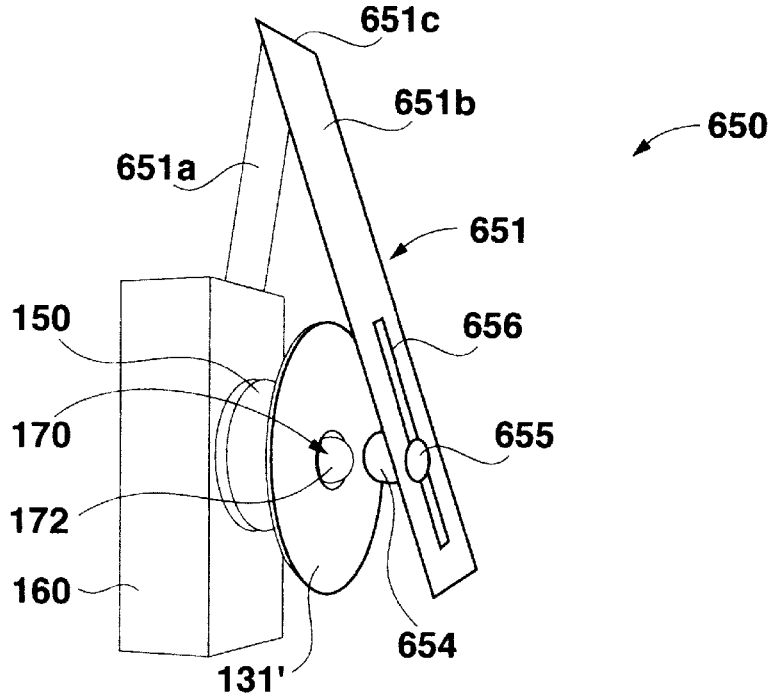
FIGS. 9A and 9B depict two configurations of another swinging-motion mechanism which converts rotational motion in a first plane to a swinging motion in the first plane.
Figure 9B:
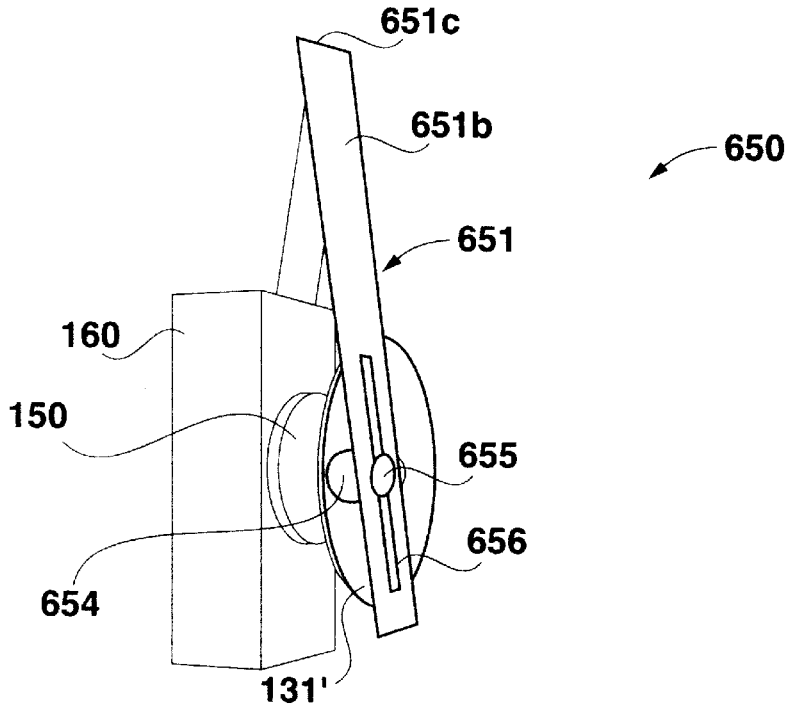

Close-up perspective views of another swinging-motion mechanism 650 which is used to animate the nose 650 of FIG. 6 are shown in FIGS. 9A and 9B. The flap 651 is made of cardboard or chipboard, and is folded at fold 651*c* to form a flap strut 651*a* and a flap wing 651*b*. For ease of representation and clarity the flap wing 651*b* is depicted as a rectangular element. However, it should be understood that the flap wing 651*b* may have a wide variety of shapes so as to depict a wide range of objects, whether realistic or fanciful, such as the nose 650 of FIG. 6. The flap strut 651*a* is attached to the upper side surface 183 of the base block 160 using adhesive tape (not visible) and projects upwards therefrom. A circular cam arm 131' is mounted on the front surface of the pulley wheel 150 such that the central aperture 331' in the circular cam arm 131' is centered around the head 172 of the pulley axle 170. The flap wing 651*b* has a vertically oriented slot 656. The legs 357 of a removable rivet 655 (see FIG. 3G) pass through the slot 656, a bore (not visible) in wooden bead 654, and the small hole 332' in the circular cam arm 131' to movably connect the flap wing 651*a* to the circular cam arm 131'. The contact of the head 356 of the rivet 655 and the ends 359 of the legs 357 of the rivet 655 which are bent outwards, circular cam arm 131', bead 654 and flap wing 651*b* is made loose enough that the rivet 655 can slide freely along the slot 656 and can rotate freely relative to the circular cam arm 131'.

As shown by the sequence of depictions of FIGS. 9A and 9B, as the pulley wheel 150 rotates, the bottom of the flap wing 651*b* repeatedly swings back and forth in the plane of rotation of the pulley wheel 150. In particular, when the circular cam arm 131' is oriented so that the bead 654 is at the right side of the circular cam arm 131' as shown in FIG. 9A, the flap wing 651*b* is also forced to the right. As the circular cam arm 131' rotates and the bead 654 moves leftwards, the orientation of the flap wing 651*b* becomes more vertical. And when the circular cam arm 131' is oriented so that the bead 654 is at the left side of the circular cam arm 131' as shown in FIG. 9B, the flap wing 651*b* is forced to the left. This swinging-motion mechanism 650 is therefore an example of a mechanism which converts rotational motion to a swinging motion in the plane of the rotation. It should be noted that the swinging motion of the flap wing 651*b* is made possible by a flap strut 651*a* which is stiff enough to hold up the flap wing 651*b*, yet flexible enough to twist to permit the flap wing 6511*b* to swing back and forth.

While the present invention is described in terms of a preferred embodiment, many other variations are possible and are to be considered within the scope of the invention. For instance: the adhesive tape may have a first side covered with a permanent adhesive and a second side covered with a non-permanent, and preferably cleanable, adhesive, so the tape may be removably attached to a wall but is not detachable from the base of the pulley; the string may be a rope or thread or any elongated flexible tethering means; the string may be made of nylon, polyester, cotton, silk, or any other sufficiently strong and flexible material; the string, components of the pulleys, or the pulley-decorating cutouts may be composed of or coated with a glow-in-the-dark material; the components, other than the string, made be made of wood, plastic, metal, or any other material; a handle ball may be replaced with a handle ring, or a gripping object of some other shape, or no gripping object may be included and the string may be gripped directly; the removably rivets may be of a type other than round-head brass paper fasteners; the toy may include a noise-making mechanism, such as a mechanism having a gear shaped cutout where the teeth of the gear strike another element to produce noise; the toy can be used to perform other household functions, such as closing a door or straightening sheets on a bed; the two-dimensional components which require folding, i.e., the cam struts and the folded planar components of the various mechanisms, may be made of any stiff but foldable material such as cardboard, chipboard, stiff paper, plastic, plastic-coated paper, metal, etc.; the planar components may be made of any stiff material such as cardboard, chipboard, stiff paper, wood, plastic, plastic-coated paper, metal, etc.; the mechanisms powered by the pulleys may be preconstructed and may use other types of components; the disks, propellers and other cutouts may be decorated with solid bright colors, concentric circles of color, spirals of color, pie sectors of color, and so on; the disks, propellers and other cutouts may be decorated with colors or patterns that produce optical illusions, such as a multicolor pattern that appears white when rotated, or a pattern that utilizes aliasing effects associated with incandescent lighting powered by alternating-current electricity to appear to rotate at a speed different from the actual speed of rotation; the planar cutouts may be attached to the pulley wheels by other means, such as Velcro™ connections, snap-fit mechanisms, etc.; the baseblocks may be attached to walls by other means, such as Velcro™ connections, magnets, etc.; the tape need not have a foam body, or a polyester carrier, or an acrylic-based adhesive; human or animal figures, vehicles, and other objects may be incorporated in mechanisms driven by the rotations the pulley wheels so that they are animated by the rotations; a propeller cutout may have three or more blade; pulley wheels may have different radii so that the cutouts and mechanisms attached thereto are driven at different speeds; and so on. Many other variations are also to be considered within the scope of the present invention. Thus, the scope of the present invention should be determined not by the examples given herein, but rather by the appended claims and their legal equivalents.

What is claimed is:

1. A string-pull construction toy comprising:

a string having a handle end and a distal end;

a first pulley having a first base, a first axle extending from a first front surface of said first base, and a first pulley wheel rotatably mounted on said first axle, said first pulley wheel having a first circumferential groove;

a first non-permanent adhesive attachable to a first rear surface of said first base for mounting said first base on a first room-environment surface; and a first string termination attachment for attachment to said distal end of said string, a first weight of said first string termination attachment providing tension on said string when said string is passed over said first circumferential groove in said first pulley wheel and said handle end of said string is pulled, pulling of said string thereby causing rotation of said first pulley wheel.

2. The string-pull construction toy of claim 1 further including:

a second pulley having a second base, a second axle extending from a second front surface of said second base, and a second pulley wheel rotatably mounted on said second axle, said second pulley wheel having a second circumferential groove; and a second non-permanent adhesive attachable to a second rear surface of said second base for mounting said second base on a second room-environment surface, said first string termination attachment providing tension on said string when said string is passed over said second circumferential groove in said second pulley wheel and said handle end of said string is pulled, pulling of said string thereby causing rotation of said second pulley wheel.

3. The string-pull construction toy of claim 2 wherein said first room-environment surface is the same as said second room-environment surface.

4. The string-pull construction toy of claim 1 wherein said first room-environment surface is a wall.

5. The string-pull construction toy of claim 1 wherein said first room-environment surface is a ceiling.

6. The string-pull construction toy of claim 1 wherein said first rear surface of said first base is opposite said first front surface of said first base.

7. The string-pull construction toy of claim 1 further including:

a visually-interesting pulley wheel attachment; and a non-permanent adhesive for attachment of said visually-interesting pulley wheel attachment to said first pulley wheel.

8. The string-pull construction toy of claim 7 wherein said visually-interesting pulley wheel attachment is substantially planar and said non-permanent adhesive is for attachment of said visually-interesting pulley wheel attachment to a front surface of said first pulley wheel.

9. The string-pull construction toy of claim 2 further including:

a first visually-interesting pulley wheel attachment;

a second visually-interesting pulley wheel attachment;

a first non-permanent adhesive for attachment of said first visually-interesting pulley wheel attachment to said first pulley wheel; and a second non-permanent adhesive for attachment of said second visually-interesting pulley wheel attachment to said second pulley wheel.

10. The string-pull construction toy of claim 7 wherein said visually-interesting pulley wheel attachment is a mechanism which converts said rotational motion of said first pulley wheel to a different motion.

11. The string-pull construction toy of claim 10 wherein said different motion is also a rotational motion.

12. The string-pull construction toy of claim 10 wherein said different motion is a reciprocating motion.

13. The string-pull construction toy of claim 10 wherein said different motion is a swinging motion.

14. The string-pull construction toy of claim 10 wherein said different motion is a chaotic motion.

15. The string-pull construction toy of claim 1 wherein said first string termination attachment attaches said string to a room object.

16. The string-pull construction toy of claim 15 wherein said room object is a light switch.

17. The string-pull construction toy of claim 15 wherein said room object is a door.

18. The string-pull construction toy of claim 1 wherein said first string termination attachment is a weight attached to said distal end of said string.

19. The string-pull construction toy of claim 1 wherein said first string termination attachment is a length of said string having sufficient weight to cause rotation of said first pulley as said string is pulled.

20. The string-pull construction toy of claim 1 wherein said first string termination attachment is a connection of said handle end of said string to said distal end of said string.

21. The string-pull construction toy of claim 1 wherein a first distance from said first circumferential groove in said pulley wheel to said first rear surface of said first base is less than a second distance from a longitudinal axis of said first axle to a closest side surface of said first base.

22. The string-pull construction toy of claim 1 wherein said first distance is substantially less than said second distance.

23. The string-pull construction toy of claim 2 further including:

a third pulley having a third base, a third axle extending from a third front surface of said third base, and a third pulley wheel rotatably mounted on said third axle, said third pulley wheel having a third circumferential groove;

a third non-permanent adhesive; and a fourth non-permanent adhesive, said third and fourth non-permanent adhesives being attachable to first and second side surfaces of said third base for mounting said third base at a junction of said first and second room-environment surfaces with said first side surface attached to said first room-environment surface and said second side surface attached to said second room-environment surface, said first string termination attachment providing tension on said string when said string is passed over said third circumferential groove in said third pulley wheel and said handle end of said string is pulled, pulling of said string thereby causing rotation of said third pulley wheel.

24. The string-pull construction toy of claim 2 further including:

a fourth base having a fourth rear surface and third and fourth side surfaces;

a fifth non-permanent adhesive;

a sixth non-permanent adhesive; and a seventh non-permanent adhesive, said fifth and sixth non-permanent adhesives being attachable to third and fourth side surfaces of said fourth base for mounting said fourth base at said junction of said first and second room-environment surfaces with said third side surface attached to said first room-environment surface and said fourth side surface attached to said second room-environment surface, and said seventh non-permanent adhesives being attachable to said fourth rear surface of said fourth base for mounting said fourth base on said third rear surface of said third base.

25. The string-pull construction toy of claim 1 further including:

a second pulley having a second base, a second axle extending from a second front surface of said second base, and a second pulley wheel rotatably mounted on said second axle, said second pulley wheel having a second circumferential groove; and a second non-permanent adhesive attachable to first side surface of said second base for mounting said second base on said first room-environment surface, said first room-environment surface being a ceiling, with said first side surface attached to said first room-environment surface, said first string termination attachment providing tension on said string when said string is passed over said second circumferential groove in said second pulley wheel and said handle end of said string is pulled, pulling of said string thereby causing rotation of said second pulley wheel, said second pulley being the initial one from said handle end of said string.

26. The string-pull construction toy of claim 25 further including:

a third base having a third rear surface and a second side surface;

a third non-permanent adhesive; and a fourth non-permanent adhesive, said third non-permanent adhesive being attachable to said second side surfaces of said third base for mounting said third base on said first room-environment surface, and said fourth non-permanent adhesives being attachable to said third rear surface of said third base for mounting said third base on said second rear surface of said second base.

27. The string-pull construction toy of claim 1 further including a second string termination attachment for attachment to said handle end of said string, for gripping when said string is pulled at said handle end thereof.

28. The string-pull construction toy of claim 27 wherein a second weight of said second string termination attachment provides tension on said string when said first string termination attachment is gripped and said string at said distal end is pulled, pulling of said string thereby causing rotation of said first pulley wheel.

29. The string-pull construction toy of claim 1 further including:

a cam arm mounted on said first pulley wheel so as to rotate about a center of rotation of said first pulley wheel; and a cam strut rotatably mounted on said cam arm at a mount point on said cam arm removed from said center of rotation, said cam strut being slidably mounted at a distal end of said cam strut on said string, passing, over said first circumferential groove of said pulley, whereby pulling of said string produces rotation of said cam arm and reciprocation of said cam strut.

30. The string-pull construction toy of claim 29 wherein said string passes through a first strut aperture at a distal end of said cam strut.

31. The string-pull construction toy of claim 30 wherein said cam strut has a slit from an exterior edge of said distal end to said first strut aperture, allowing said string to be located in said first strut aperture by sliding said string through said slit.

32. The string-pull construction toy of claim 29 wherein said cam strut is rotatably mounted on said cam arm by a rivet passing through a second strut aperture in said cam strut and a mount point aperture at said mount point on said cam arm.

33. The string-pull construction toy of claim 32 further including a bead having a bore therein, wherein said rivet passes through said bore in said bead, sandwiching said bead between said cam arm and said cam strut.

34. The string-pull construction toy of claim 1 further including:

a cam arm mounted on said first pulley wheel so as to rotate about a center of rotation of said first pulley wheel;

a bendable tongue element rotatably mounted on said cam arm at a mount point on said cam arm removed from said center of rotation; and a tongue guide mounted on said base and having a slit therein located in front of said pulley wheel, said slit having dimensions larger than cross-sectional dimensions of said tongue element and said tongue element protruding through said slit in said forward direction, rotation of said cam arm varying a distance of said mount point from said slit and causing an amount by which said tongue element protrudes from said slit in said forward direction to vary.

35. The string-pull construction toy of claim 34 wherein said tongue element is rotatably mounted on said cam arm by a rivet passing through a tongue element aperture in said tongue element and a mount point aperture at said mount point on said cam arm.

36. The string-pull construction toy of claim 35 further including a bead having a bore therein, wherein said rivet passes through said bore in said bead, sandwiching said bead between said cam arm and said tongue element.

37. The string-pull construction toy of claim 1 farther including:

a cam arm mounted on said first pulley wheel so as to rotate about a center of rotation of said first pulley wheel;

a piston rotatably mounted on said cam arm at a mount point on said cam arm removed from said center of rotation; and a swingable flap secured relative to said base at a pivot point and pivotable about said pivot point in a plane perpendicular to a plane of said rotation of said first pulley wheel, said piston being attached to said swingable flap at a drive point removed from said pivot point, and rotation of said cam arm varying a first degree of forward orientation of said piston, causing a second degree of forward orientation of said swingable flap at said drive point to vary as said first pulley wheel rotates.

38. The string-pull construction toy of claim 37 wherein said piston is rotatably mounted on said cam arm by a rivet passing through a piston aperture in said piston and a mount point aperture at said mount point on said cam arm.

39. The string-pull construction toy of claim 38 further including a bead having a bore therein, wherein said rivet passes through said bore in said bead, sandwiching said bead between said cam arm and said piston.

40. The string-pull construction toy of claim 1 further including:

a cam arm mounted on said first pulley wheel so as to rotate about a center of rotation of said first pulley wheel;

a cam shaft extending in said forward direction from said cam arm at a mount point on said cam arm removed from said center of rotation; and a swingable flap extending in front of said first pulley wheel, secured relative to said base at a pivot point and pivotable about said pivot point in a plane of said rotation of said first pulley wheel, said swingable flap having a slit therein oriented along a direction from said pivot point to said first pulley wheel and said cam shaft passing through and slidably retained in said slit, rotation of said cam arm varying an angle between said pivot point said center of rotation of said first pulley wheel and said cam shaft, and said rotation of said cam arm causing said swingable flap to reciprocate in said plane of said rotation of said first pulley wheel as said first pulley wheel rotates.

41. The string-pull construction toy of claim 1 further including:

a cam arm mounted on said first pulley wheel so as to rotate about a center of rotation of said first pulley wheel; and a first pendulum member rotatably mounted on said cam arm at a first mount point on said cam arm removed from said center of rotation of said first pulley wheel; and a second pendulum member rotatably mounted on said first pendulum member at a second mount point on said first pendulum member removed from said first mount point, whereby said rotation of said first pulley wheel causes chaotic motion of said first and second pendulum members.

42. The string-pull construction toy of claim 1 wherein a body layer of said first nonpermanent adhesive is flexible foam.

43. The string-pull construction toy of claim I wherein said flexible foam is an open-cell foam.

* * * * *